US010731289B2

(12) United States Patent
Kim et al.

(10) Patent No.: US 10,731,289 B2
(45) Date of Patent: Aug. 4, 2020

(54) CLOTHES DRYER AND METHOD FOR PERFORMING STERILIZATION COURSE THEREOF

(71) Applicant: Samsung Electronics Co., Ltd., Suwon-si, Gyeonggi-do (KR)

(72) Inventors: Do-haeng Kim, Suwon-si (KR); Hye-joon Seok, Suwon-si (KR); Sang-oh Yoo, Hwaseong-si (KR); Young-min Choi, Yongin-si (KR); Ju-dai Kim, Seoul (KR); Yong-joon Jang, Suwon-si (KR); Seong-min Oak, Hwaseong-si (KR); Hyung-woo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 10 days.

(21) Appl. No.: 16/154,070

(22) Filed: Oct. 8, 2018

(65) Prior Publication Data

US 2019/0127905 A1 May 2, 2019

(30) Foreign Application Priority Data

Oct. 26, 2017 (KR) ..... 10-2017-0140449
Feb. 23, 2018 (KR) ..... 10-2018-0022271

(51) Int. Cl.
*D06F 58/30* (2020.01)
*D06F 58/04* (2006.01)
(Continued)

(52) U.S. Cl.
CPC ..... *D06F 58/30* (2020.02); *D06F 58/04* (2013.01); *D06F 58/203* (2013.01); *D06F 58/38* (2020.02);
(Continued)

(58) Field of Classification Search
CPC ..... D06F 58/28; D06F 58/04; D06F 58/283; D06F 2058/2829; D06F 2058/2841;
(Continued)

(56) References Cited

U.S. PATENT DOCUMENTS 4,086,707 A * 5/1978 Bochan ..... D06F 58/02 192/82 T
6,745,495 B1 * 6/2004 Riddle ..... D06F 58/28 34/493
(Continued)

FOREIGN PATENT DOCUMENTS

JP 2004-016265 A 1/2004
JP 4265079 B2 5/2009
(Continued)

OTHER PUBLICATIONS

International Search Report dated Jan. 17, 2019 in connection with International Patent Application No. PCT/KR2018/0120873, 3 pages.
(Continued)

*Primary Examiner* — Stephen M Gravini

(57) ABSTRACT

A clothes dryer includes a drum configured to accommodate an object to be dried; a first sensor configured to sense a dry state of the object to be dried accommodated in the drum; a heating unit configured to heat air supplied into the drum; a blower including a fan configured to generate a flow of the air passing through the inside of the drum; a second sensor configured to sense a temperature of the air discharged from the drum; and a processor configured to control a rotation speed of the drum, a temperature of the air discharged from the drum, and a rotation speed of the fan.

20 Claims, 12 Drawing Sheets

(51) Int. Cl.

| | |
|---|---|
| ***D06F 58/20*** | (2006.01) |
| ***D06F 58/38*** | (2020.01) |
| ***D06F 103/00*** | (2020.01) |
| ***D06F 103/08*** | (2020.01) |
| ***D06F 103/12*** | (2020.01) |
| ***D06F 103/34*** | (2020.01) |
| ***D06F 103/36*** | (2020.01) |
| ***D06F 103/44*** | (2020.01) |
| ***D06F 103/50*** | (2020.01) |
| ***D06F 105/24*** | (2020.01) |
| ***D06F 105/26*** | (2020.01) |
| ***D06F 105/28*** | (2020.01) |
| ***D06F 105/46*** | (2020.01) |

(52) U.S. Cl.
CPC ..... *D06F 2103/00* (2020.02); *D06F 2103/08* (2020.02); *D06F 2103/12* (2020.02); *D06F 2103/34* (2020.02); *D06F 2103/36* (2020.02); *D06F 2103/44* (2020.02); *D06F 2103/50* (2020.02); *D06F 2105/24* (2020.02); *D06F 2105/26* (2020.02); *D06F 2105/28* (2020.02); *D06F 2105/46* (2020.02)

(58) Field of Classification Search
CPC ..... D06F 2058/2864; D06F 2058/287; D06F 2058/2877; D06F 2058/289
USPC ..... 34/527
See application file for complete search history.

(56) References Cited

U.S. PATENT DOCUMENTS

| | | | | |
|---|---|---|---|---|
| 8,196,242 | B2 * | 6/2012 | Kim | D06F 58/28 68/20 |
| 9,359,713 | B2 * | 6/2016 | Kang | D06F 25/00 |
| 10,094,065 | B2 * | 10/2018 | Kim | D06F 58/28 |
| 10,487,443 | B1 * | 11/2019 | D'Anna | F26B 3/343 |
| 2004/0068889 | A1 * | 4/2004 | Park | D06F 58/24 34/446 |
| 2005/0278974 | A1 | 12/2005 | Chung | |
| 2007/0251119 | A1 * | 11/2007 | Kim | D06F 58/28 34/546 |
| 2009/0282696 | A1 * | 11/2009 | Kim | D06F 58/28 34/493 |
| 2013/0255101 | A1 | 10/2013 | Lee et al. | |
| 2014/0082852 | A1 | 3/2014 | Hanau et al. | |
| 2019/0127905 | A1 * | 5/2019 | Kim | D06F 58/28 |

FOREIGN PATENT DOCUMENTS

| | | | | |
|---|---|---|---|---|
| JP | 2013-244171 | A | 12/2013 | |
| KR | 10-2005-0119268 | A | 12/2005 | |
| KR | 10-0662760 | B1 | 1/2007 | |
| KR | 10-0999266 | B1 | 12/2010 | |
| KR | 10-1203849 | B1 | 11/2012 | |
| KR | 10-2014-0023342 | A | 2/2014 | |
| KR | 10-1476185 | B1 | 12/2014 | |
| WO | WO-2019083209 | A1 * | 5/2019 | D06F 58/28 |

OTHER PUBLICATIONS

Written Opinion of the International Searching Authority dated Jan. 17, 2019 in connection with International Patent Application No. PCT/KR2018/012087, 6 pages.

* cited by examiner

CLOTHES DRYER AND METHOD FOR PERFORMING STERILIZATION COURSE THEREOF

CROSS-REFERENCE TO RELATED APPLICATIONS AND CLAIM OF PRIORITY

This application claims priority under 35 U.S.C. § 119 to Korean Patent Application No. 10-2017-0140449 filed on Oct. 26, 2017 and Korean Patent Application No. 10-2018-0022271 filed on Feb. 23, 2018 in the Korean Intellectual Property Office, the disclosures of which are incorporated herein by reference in their entireties.

BACKGROUND

1. Field

Apparatuses and methods consistent with the disclosure relates to a clothes dryer and a method for performing a sterilization course thereof and, and more particularly, to a clothes dryer capable of performing sterilization on an object to be dried and a method for performing a sterilization course thereof.

2. Description of Related Art

Generally, a drier is a device for drying and sterilizing a wet object to be dried, for example, by rotating a drum containing clothes and applying hot air to the object to be dried for a predetermined time.

However, in the conventional dryer, since a sterilization course is performed collectively without discriminating a state of the object to be dried, that is, whether the object to be dried is dry clothes or wet clothes, there was a problem in that energy efficiency for the sterilization quality and sterilization course is lowered.

Accordingly, there has been a demand for a method for more efficient sterilization course according to the state of the object to be dried.

SUMMARY

Embodiments of the disclosure overcome the above disadvantages and other disadvantages not described above. Also, the disclosure is not required to overcome the disadvantages described above, and an embodiment of the disclosure may not overcome any of the problems described above.

The disclosure provides a clothes dryer capable of performing a sterilization course by different processes according to a dry state of an object to be dried, and a method for performing the sterilization course thereof.

According to an aspect of the disclosure, a clothes dryer includes a drum configured to accommodate an object to be dried; a first sensor configured to sense a dry state of the object to be dried accommodated in the drum; a heating unit configured to heat air supplied into the drum; a blower including a fan configured to generate a flow of the air passing through the inside of the drum; a second sensor configured to sense a temperature of the air discharged from the drum; and a processor configured to control a rotation speed of the drum, a temperature of the air discharged from the drum, and a rotation speed of the fan, wherein the clothes dryer performs: a first course of controlling the heating unit and the blower, wherein the air discharged from the drum has at a first temperature or higher while the rotation speed of the fan is maintained at a first speed; a second course of controlling the heating unit and the blower, wherein the air discharged from the drum has at a second temperature or higher while the rotation speed of the fan is maintained at a second speed; and a third course of controlling the heating unit and the blower, wherein the air discharged from the drum has at a third temperature or higher while the rotation speed of the fan is maintained at a third speed, wherein the processor is configured to control the clothes dryer to perform the second course after performing the first course or perform the third course without performing the first course and the second course, based on the dry state of the object to be dried sensed by the first sensor, wherein the first speed is greater than the second speed and the third speed, and wherein the third temperature is higher than the first temperature and the second temperature.

The clothes dryer may further include: a flow path that is a circulation path of the air discharged from the drum and flowing into the drum, wherein the heating unit includes: a compressor connected to the flow path for cooling and heating the air circulating through the flow path.

When the data sensed by the first sensor is less than or equal to a predetermined value, the processor may be configured to start the third course to drive the compressor at a predetermined operation frequency and drive the fan at a predetermined rotation speed, and, when the data sensed by the second sensor reaches a first threshold value, maintain a temperature of the drum at the third temperature or higher for a predetermined time.

When the data sensed by the first sensor is greater than the predetermined value, the processor may be configured to perform the first course, and then, when the data sensed by the first sensor is less than or equal to the predetermined value, start the second course to drive the fan at the predetermined rotation speed.

The processor may be configured to drive the compressor according to the predetermined operating frequency in the first course, drive the fan at the predetermined rotation speed, start the second course when a drying process ends, and reduce the rotation speed of the fan.

When the data sensed by the second sensor reaches a second threshold value after the second course is started, the processor may be configured to maintain a temperature of the drum at the second temperature or higher for a predetermined time.

The clothes dryer may further include a flow path that is a circulation path of the air discharged from the drum and flowing into the drum, wherein the heating unit includes: a compressor connected to the flow path for cooling and heating the air circulating through the flow path; and a heater configured to heat the air flowing into the drum through the flow path.

When the data sensed by the first sensor is less than or equal to a predetermined value, the processor may be configured to start the third course to drive the heater, turn off the compressor, and drive the fan at a predetermined rotation speed, and, when the data sensed by the second sensor reaches a first threshold value, maintain a temperature of the drum at the third temperature or higher for a predetermined time through on/off of the heater.

When the data sensed by the first sensor is greater than the predetermined value, the processor may be configured to perform the first course on the object to be dried, and then, when the data sensed by the first sensor is less than or equal to the predetermined value, start the second course.

The processor may be configured to drive the compressor according to the predetermined operating frequency in the first course, drive the fan at the predetermined rotation speed, and, when the first course ends, start the second course to drive the heater, turn off the compressor and drive the fan at the predetermined rotation speed.

When the data sensed by the second sensor reaches a second threshold value after starting the second course, the processor may be configured to maintain a temperature of the drum at the second temperature or higher for a predetermined time through on/off of the heater.

The processor may be configured to perform a cooling process when the second course or the third course ends.

A rotation speed of a fan in the cooling process may be higher than a rotation speed of the fan in the second course and the third course.

According to another aspect of the disclosure, a clothes dryer includes a drum configured to accommodate an object to be dried; a first sensor configured to sense a dry state of the object to be dried accommodated in the drum; a heating unit configured to heat air supplied into the drum; a blower configured to generate a flow of the air passing through the inside of the drum; a second sensor configured to sense a temperature of the air discharged from the drum; and a processor configured to control a rotation speed of the drum and a temperature of the air discharged from the drum, wherein the clothes dryer performs: a first course of controlling the drum and the heating unit, wherein the air discharged from the drum has at a first temperature or higher while the rotation speed of the drum is maintained at a first speed; a second course of controlling the drum and the heating unit, wherein the air discharged from the drum has at a second temperature or higher while the rotation speed of the drum is maintained at a second speed; and a third course of controlling the drum and the heating unit, wherein the air discharged from the drum has at a third temperature or higher while the rotation speed of the drum is maintained at a third speed, wherein the processor is configured to control the clothes dryer to perform the second course after performing the first course or perform the third course without performing the first course, based on the dry state of the object to be dried sensed by the first sensor, wherein the first speed is greater than the second speed and the third speed, and wherein the third temperature is higher than the first temperature and the second temperature.

According to another aspect of the disclosure, a method for performing a sterilization course of a clothes dryer including a fan and a drum includes sensing a dry state of an object to be dried through a first sensor for sensing the dry state of the object to be dried contained in the drum when the sterilization course is started; and performing a second course after performing a first course or performing a third course without performing the first course and the second course, based on the dry state of the object to be dried sensed by the first sensor, wherein a first course is performed to allow air discharged from the drum to have at a first temperature or higher while the rotation speed of the fan is maintained at a first speed, wherein a second course is performed to allow the air discharged from the drum to have at a second temperature or higher while the rotation speed of the fan is maintained at a second speed; wherein a third course is performed to allow the air discharged from the drum to have at a third temperature or higher while the rotation speed of the fan is maintained at a third speed, wherein the first speed is greater than the second speed and the third speed, and wherein the third temperature is higher than the first temperature and the second temperature.

The performing may include: when the data sensed by the first sensor is less than or equal to a predetermined value, starting the third course to drive the compressor included in the clothes dryer at a predetermined operation frequency and drive the fan at a predetermined rotation speed, and, when data sensed by a second sensor configured to sense a temperature of air discharged from the drum reaches a first threshold value, maintaining the temperature of the drum at the third temperature or higher for a predetermined time.

The performing may include: when the data sensed by the first sensor is greater than the predetermined value, performing the first course, and then, when the data sensed by the first sensor is less than or equal to the predetermined value, starting the second course to drive the fan at the predetermined rotation speed.

The performing may include: driving the compressor according to the predetermined operating frequency in the first course, driving the fan at the predetermined rotation speed, starting the second course when the first course ends, and reducing the rotation speed of the fan.

The performing may include: when the data sensed by the second sensor reaches a second threshold value after starting the second course, maintaining a temperature of the drum at the second temperature or higher for a predetermined time.

The performing may include: when the data sensed by the first sensor is less than or equal to a predetermined value, starting the third course to drive a heater included in the dryer clothes, turning off a compressor included in the dryer clothes, and driving the fan at a predetermined rotation speed, and, when data sensed by a second sensor configured to sense a temperature of air discharged from the drum reaches a first threshold value, maintaining the temperature of the drum at the third temperature or higher for a predetermined time through on/off of the heater.

The performing may include: when the data sensed by the first sensor is greater than the predetermined value, performing the first course, and then, when the data sensed by the first sensor is less than or equal to the predetermined value, starting the second course.

The performing may include: driving the compressor according to the predetermined operating frequency in the first course, driving the fan at the predetermined rotation speed, and, when the first course ends, starting the second course to drive the heater, turn off the compressor and drive the fan at the predetermined rotation speed.

The performing may include: when the data sensed by the second sensor reaches a second threshold value after starting the second course, maintaining a temperature of the drum at the second temperature or higher for a predetermined time through on/off of the heater.

The method may further include performing a cooling process when the second course or the third course ends.

A rotation speed of a fan in the cooling process may be higher than a rotation speed of the fan in the second course and the third course.

According to another aspect of the disclosure, a method for performing a sterilization course of a clothes dryer including a drum includes sensing a dry state of an object to be dried through a first sensor for sensing the dry state of the object to be dried contained in the drum when the sterilization course is started; and performing a second course after performing a first course or performing a third course without performing the first course, based on the dry state of the object to be dried sensed by the first sensor, wherein a first course is performed to allow air discharged from the drum to have at a first temperature or higher while the rotation speed of the drum is maintained at a first speed, wherein a second course is performed to allow the air discharged from the drum to have at a second temperature or higher while the rotation speed of the drum is maintained at a second speed; wherein a third course is performed to allow the air discharged from the drum to have at a third temperature or higher while the rotation speed of the drum is maintained at a third speed, wherein the first speed is greater than the second speed and the third speed, and wherein the third temperature is higher than the first temperature and the second temperature.

As described above, according to various embodiments of the disclosure, a sterilization course is performed by different processes according to a dry state of an object to be dried, thereby improving the sterilization quality and increasing the energy efficiency.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWING

The above and/or other aspects of the disclosure will be more apparent by describing certain embodiments of the disclosure with reference to the accompanying drawings, in which.

DETAILED DESCRIPTION

Figure 1:
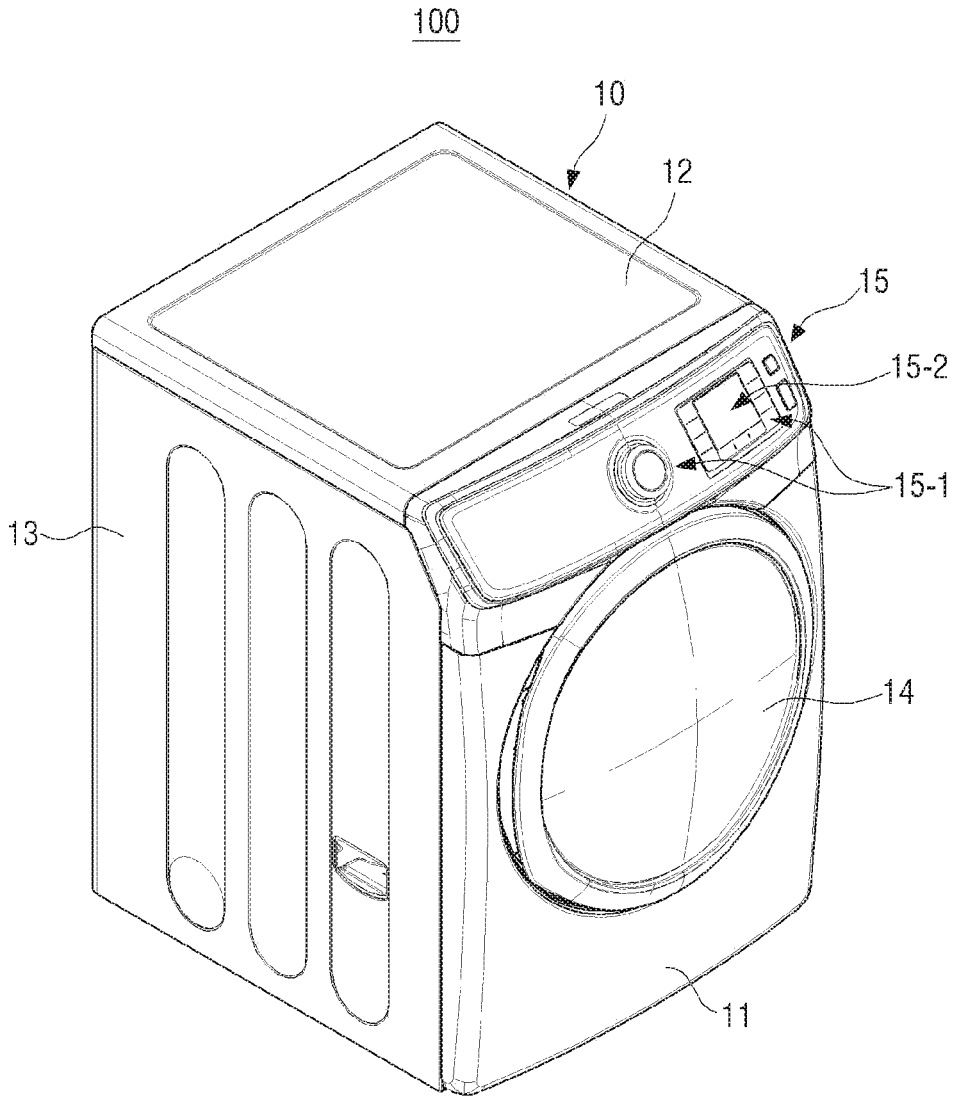
FIGS. 1 and 2 are perspective views showing a clothes dryer according to an embodiment of the disclosure.

FIGS. 1 through 12, discussed below, and the various embodiments used to describe the principles of the disclosure in this patent document are by way of illustration only and should not be construed in any way to limit the scope of the disclosure. Those skilled in the art will understand that the principles of the disclosure may be implemented in any suitably arranged system or device.

The disclosure will now be described in detail with reference to the accompanying drawings.

Although general terms used in the disclosure are selected to describe embodiments in consideration of the functions thereof, these general terms may vary according to intentions of one of ordinary skill in the art, legal or technical interpretation, the advent of new technologies, and the like. Some terms are arbitrarily selected by the applicant of the embodiments. In this case, the meaning will be described in detail in the description of the disclosure. Accordingly, the terms used in the disclosure should be defined based on the meaning of the term, not on the name of a simple term, but on the entire contents of the disclosure.

When an element is referred to as "including" an element throughout the specification, it is to be understood that the element may include other elements as well, without departing from the other elements unless specifically stated to the contrary. Also, the terms " . . . part", "module", and the like described in the specification mean units for processing at least one function or operation, which may be implemented by hardware or software or by a combination of hardware and software.

Hereinafter, embodiments of the disclosure will be described in detail with reference to the accompanying drawings. The embodiments described below will be described on the basis of embodiments best suited to understand the technical features of the disclosure and the technical features of the disclosure are not limited by the embodiments described and exemplify that the disclosure may be implemented as in the embodiments described below.

Therefore, it will be understood by those skilled in the art that various changes in form and details may be made therein without departing from the spirit and scope of the disclosure as defined by the appended claims. In order to facilitate understanding of the embodiments to be described below, in the reference numerals shown in the accompanying drawings, among the components having the same function in each embodiment, the related components are denoted by the same or an extension line number. Also, the attached drawings are not drawn to scale in order to facilitate understanding of the disclosure, but the dimensions of some of the components may be exaggerated.

FIG. 1 is a perspective view showing a clothes dryer 100 according to an embodiment of the disclosure.

The clothes dryer 100 (or the dryer) to be described below is a device for drying an object to be dried by supplying heated and dried hot air to a drying room containing the object to be dried. The object to be dried includes all objects capable of drying and sterilizing through hot air. For example, the object to be dried includes, but is not limited to, various types of textiles and fabrics, such as cloth, clothes, towels, blankets, etc.

As shown in FIG. 1, the clothes dryer 100 includes a main body 10 which forms an appearance. The main body 10 may have a shape of a rectangular parallelepiped extending in a vertical direction. However, this is an example for convenience of explanation and the main body 10 may be implemented in various shapes.

The main body 10 may include a front panel 11, an upper panel 12, and a side rear panel 13.

The main body 10 includes an opening 10H (see FIG. 2) formed at one side thereof and the opening 10H may be formed on the front panel 11 and thus opened toward the front of the main body 10. In this case, a door 14 may be coupled to the main body 10 to open and close the opening 10H.

A control panel 15 may be disposed on the top of the front panel 11.

The control panel 15 includes an operator 15-1 for inputting operation instructions for operating the clothes dryer 100 and a display 15-2 for displaying operation information of the clothes dryer 100.

In this case, a user may input various user instructions for operating the clothes dryer 100 through the operator 15-1. To this end, the operator 15-1 may include a button, an operation dial, and the like.

For example, the user may select an operating course (or an operating course) of the clothes dryer 100 through the operator 15-1. Here, the operating course may include a sterilization course.

The display 15-2 may display operation information of the clothes dryer 100 as a visual image. At this time, the display 15-2 may be configured as a touch screen capable of receiving an operation instruction of the user.

Figure 2:
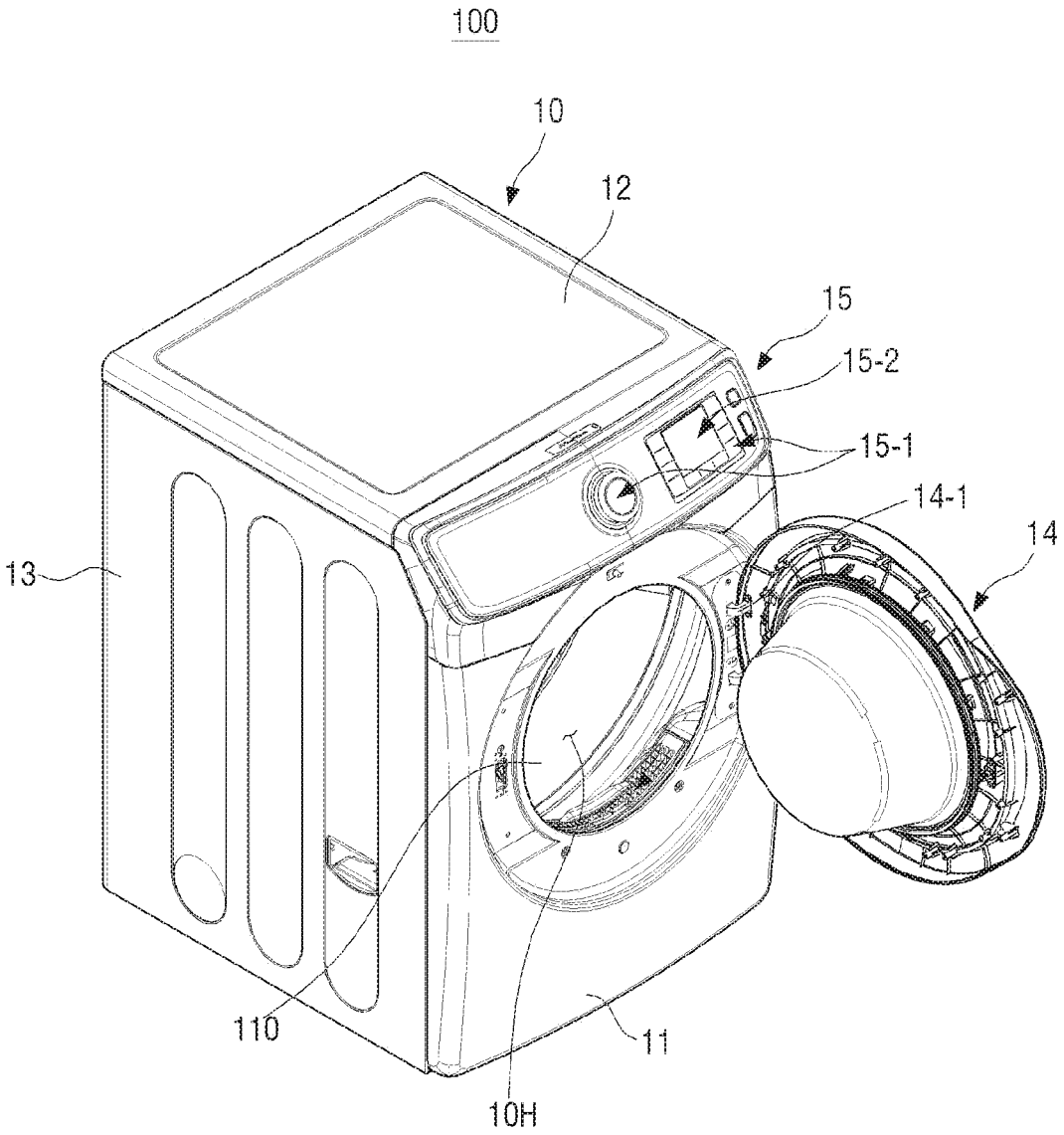

FIG. 2 is a perspective view showing an open state of the door 14 of the clothes dryer 100 shown in FIG. 1.

As shown in FIG. 2, the opening 10H is formed at one side of the main body 10 and may be formed in a circular shape on the front panel 11.

The drum 110 is rotatably disposed inside the main body 10 and may be connected to the opening 10H so that an object to be dried may be flown into the drum 110 through the opening 10H.

Specifically, the drum 110 is provided with a drying chamber (not shown) connected to the opening 10H, and the object to be dried flowing into the drying chamber (not shown) through the opening 10H may be dried by hot air flowing into the drying chamber (not shown).

Meanwhile, a motor (not shown) is provided inside the main body 10, and the drum 110 may be rotated according to a rotation of the motor (not shown). Through this, the object to be dried flowing into the drying chamber (not shown) may be tumbled so that hot air may be uniformly applied to the object to be dried.

In addition, the door 14 is coupled to the front panel 11 of the main body 10 to open and close the opening 10H.

The door 14 is pivotally coupled to the front panel 11, thereby opening and closing the opening 10H.

Specifically, as shown in FIG. 2, a hinge 14-1 may be disposed on one side of the front panel 11 adjacent to the opening 10H, and the door 14 may be connected to the hinge 14-1 to rotate with respect to the hinge 14-1, thereby opening and closing the opening 10H.

The door 14 may have a circular shape corresponding to a shape of the opening 10H, and is configured to have a diameter larger than that of the opening 10H. Accordingly, the object to be dried may be flown into the drying chamber (not shown) of the drum 110 through the opening 10H by opening the door 14.

Figure 3:
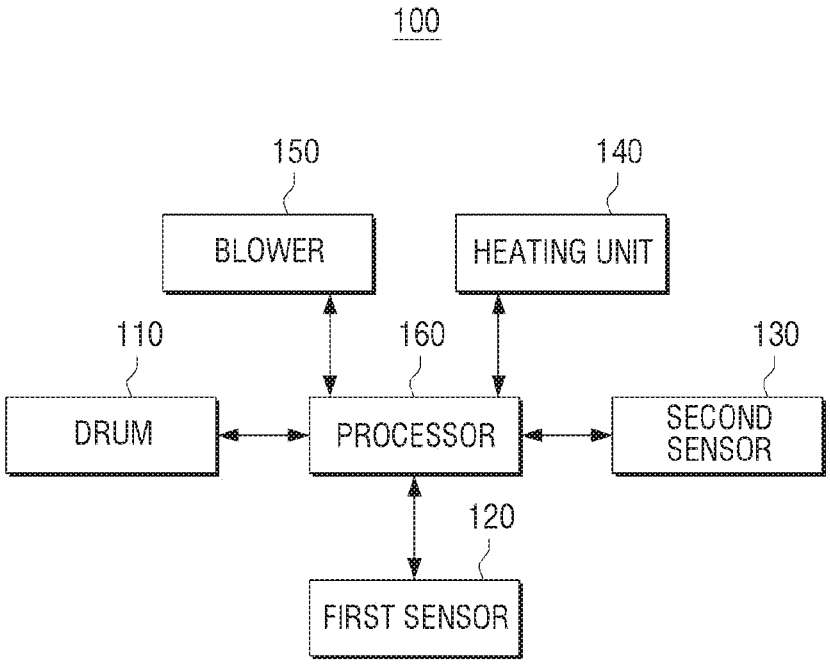
FIG. 3 is a block diagram illustrating a configuration of a clothes dryer according to an embodiment of the disclosure.

FIG. 3 is a block diagram illustrating a configuration of the clothes dryer 100 according to an embodiment of the disclosure.

Referring to FIG. 3, the clothes dryer 100 may include the drum 110, a first sensor 120, a second sensor 130, a heating unit 140, a blower 150, and a processor 160.

The drum 110 receives an object to be dried. To this end, the drum 110 is provided with a drying chamber (not shown) for receiving the object to be dried, and the object to be dried may be dried by air flowing into the drying chamber (not shown).

In this case, the drum 110 is rotatably disposed, and the object to be dried flowing into the drying chamber (not shown) may be tumbled along with the rotation of the drum 110 such that air may be uniformly applied to the object to be dried.

The first sensor 120 senses a dry state of the object to be dried contained in the drum 110. That is, the first sensor 120 is provided inside the drum 110 to sense the dry state of the object to be dried. To this end, the first sensor 120 may include a drying degree sensor.

In this case, the drying degree sensor includes two electrodes provided inside the drum 110, and when the object to be dried disposed between the two electrodes is disposed, may sense the dry state of the object to be dried based on the magnitude of a current flowing between the two electrodes and generate sensing data (e.g., a pulse value) indicating the dry state. For example, the drying degree sensor may generate lower sensing data as the object to be dried becomes dry and generate higher sensing data as the object to be dried becomes wet.

However, this is only an example, and the first sensor 120 may be implemented as various types of sensors for measuring a drying degree of the object to be dried.

The second sensor 130 senses the temperature of the air discharged from the drum 110. To this end, the second sensor 130 may include a temperature sensor. In this case, the temperature sensor may be disposed in a filter (49 in FIG. 4 or 89 in FIG. 8) to sense the temperature of the air discharged from the drum 110 and generate sensing data indicating the temperature of the air.

However, this is only an example, and the temperature sensor may sense the temperature of the drum 110 at various positions.

For example, the temperature sensor may be disposed inside the drum 110, or may be disposed at a position adjacent to the opening 11H of the drum 110 to sense the temperature of the air in the drum 110 and generate the sensing data indicating the temperature of inside the drum 110.

The heating unit 140 heats the air supplied into the drum 110.

In this case, the heating unit 140 may heat the air supplied into the drum 110 through various methods.

Figure 4:
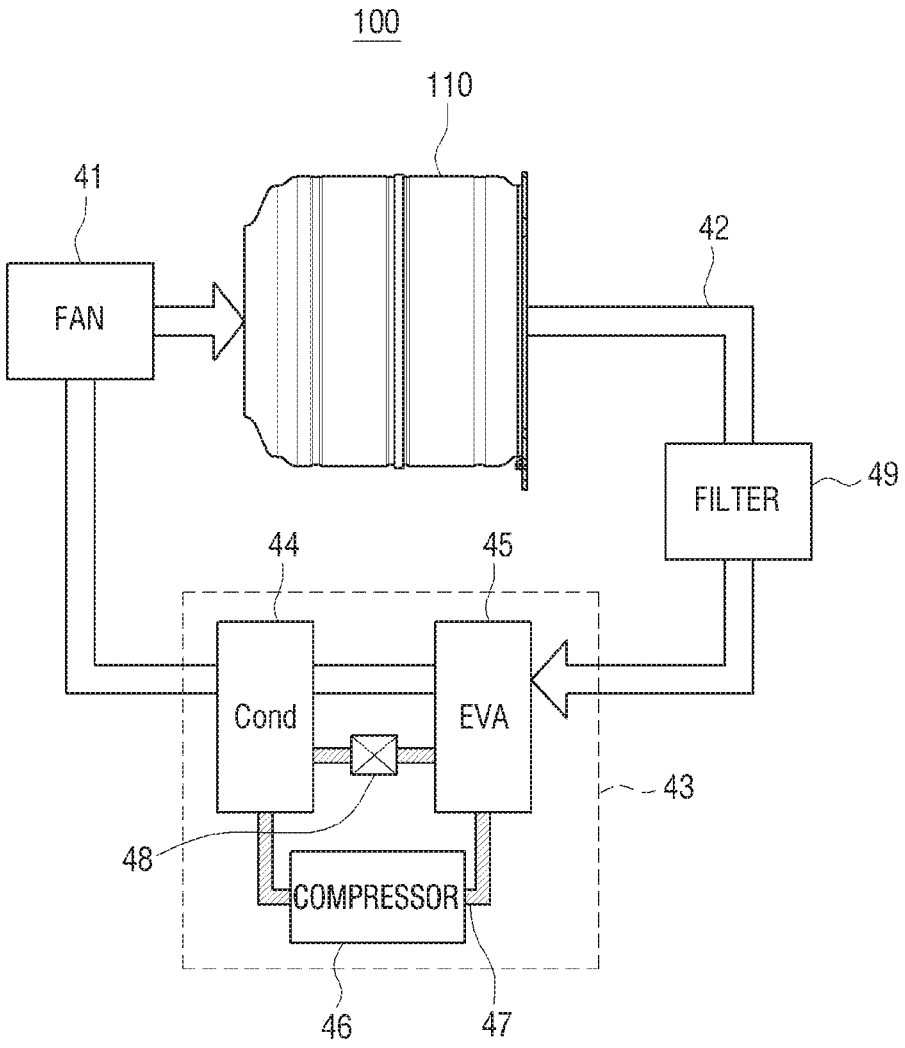
FIG. 4 is a diagram illustrating a method of driving a heat pump dryer according to an embodiment of the disclosure.

For example, the heating unit 140 may include a compressor (46 of FIG. 4) connected to a flow path and for cooling and heating air circulating in the flow path and may heat the air supplied into the drum 110 through the compressor (46 in FIG. 4).

Figure 8:
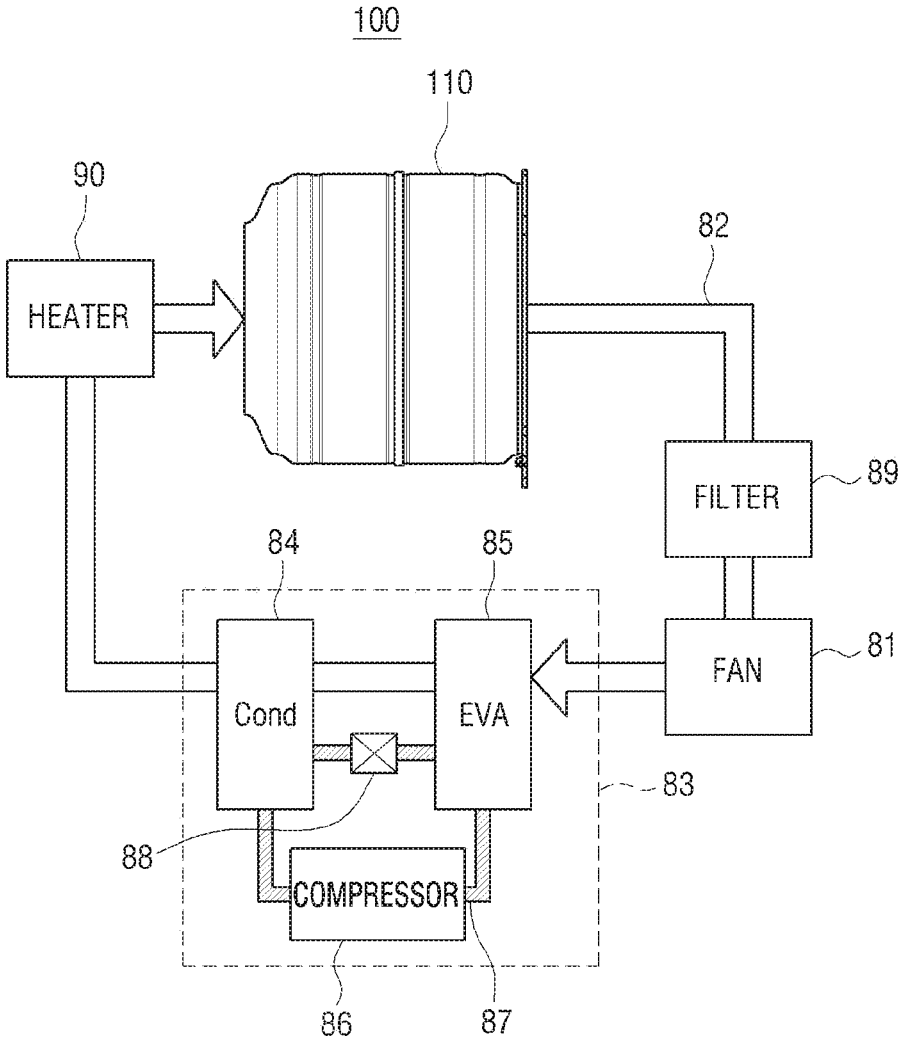
FIG. 8 is a diagram illustrating a configuration of a hybrid heat pump dryer according to an embodiment of the disclosure.

As another example, the heating unit 140 includes a compressor (86 in FIG. 8) connected to a flow path and for cooling and heating the air circulating in the flow path, and a heater (90 in FIG. 8) for heating the air flowing into the drum 110 through the flow path, and may heat the air supplied into the drum 110 through the compressor (86 in FIG. 8) and the heater (90 in FIG. 8).

The blower 150 may form a flow of the air passing through the drum 110. In this case, the blower 150 may include a fan (41 in FIG. 4 or 81 in FIG. 8) for generating a flow of the air according to a rotation.

The processor 160 controls the overall operation of the clothes dryer 100.

Specifically, the processor 160 may control the rotation speed of the drum 110, the temperature of the air discharged from the drum 110, and the rotation speed of the fan.

To this end, the processor 160 may be connected to various components included in the clothes dryer 100 to transmit and receive various data and signals. The processor 160 may generate and transmit control instructions to control various components included in the clothes dryer 100.

In this case, the processor 160 may operate, for example, an operating system or an application program to control hardware or software components connected to the processor 160 and may perform various data processing and operations. Also, the processor 160 may load and process instructions or data received from at least one of the other components into volatile memory and store various data in non-volatile memory.

To this end, the processor 160 may be implemented as a generic-purpose processor (e.g., a CPU, a GPU, or an application processor) capable of performing corresponding operations by executing one or more software programs stored in a memory device or a dedicated processor (e.g., an embedded processor) for performing the corresponding operations.

In particular, the processor 160 may perform a sterilization course of different processes according to the dry state of the object to be dried during the sterilization course on the object to be dried.

Specifically, the processor 160 may control the clothes dryer 100 to perform a second course after performing a first course or perform a third course without performing the first course and the second course, based on the dry state of the object to be dried detected by the first sensor 120.

Here, the clothes dryer 100 may perform the first course controlling the heating unit 140 and the blower 150 to allow the air discharged from the drum 110 to have a first temperature or higher while maintaining the rotation speed of the fan at a first speed, the second course controlling the heating unit 140 and the blower 150 to allow the air discharged from the drum 110 to have a second temperature or higher while maintaining the rotation speed of the fan at a second speed, and the third course controlling the heating unit 140 and the blower 150 to allow the air discharged from the drum 110 to have a third temperature or higher while maintaining the rotation speed of the fan at a third speed.

At this time, the first speed may be greater than the second speed and the third speed, and the third temperature may be higher than the first temperature and the second temperature.

Hereinafter, a method for the clothes dryer 100 of performing the sterilization course according to various embodiments will be described in more detail.

According to various embodiments of the disclosure, the clothes dryer 100 may be implemented as a heat pump dryer or a hybrid heat pump dryer.

First, referring to FIGS. 4 to 7, a method of performing the sterilization course when the clothes dryer 100 is implemented as the heat pump dryer will be described.

FIG. 4 is a diagram illustrating a configuration of the clothes dryer 100 according to an embodiment of the disclosure.

A fan 41 generates a flow of air as it rotates. In this case, the rotation speed of the fan 41 may be varied under the control of an inverter motor (or a motor) (not shown) in that the fan 41 is driven according to the inverter motor (not shown).

The air is circulated through a flow path 42 according to a rotation of the fan 41 so that the air may be flown into and discharged from the drum 110.

In this case, to dry an object to be dried contained in the drum 110, the air discharged from the drum 110 may be flown into the drum 110 again through condensation and heating.

That is, the flow path 42 is a circulation path of the air discharged from the drum 110 and flowing into the drum 110. The fan 41 causes the air to flow into the drum 110 through the rotation and circulate the air through the flow path 42.

Meanwhile, the clothes dryer 100 may include a heat pump system 43 condensing and heating the air through a refrigerant.

In this case, the refrigerant circulates in the order of an evaporator 45, a compressor 46, a condenser 44, and an expansion means 48 through a refrigerant pipe 47.

Specifically, in the evaporator 45, the refrigerant absorbs heat and evaporates. Accordingly, the evaporator 45 cools the circulating air to condense moisture through the heat exchange between the refrigerant and the circulating air. In this case, the condensed moisture may be discharged to the outside of the clothes dryer 100 through a pipe (not shown).

Meanwhile, the compressor 46 compresses the refrigerant flowing from the evaporator 45 and discharges the refrigerant to the condenser 44. In this case, the rotation speed of the compressor 46 may be varied under the control of the inverter motor (or the motor) (not shown) in that the compressor 46 is driven according to the inverter motor (not shown). That is, the operating frequency (or the driving frequency) of the compressor 46 may be varied.

In the condenser 44, the refrigerant emits heat and condenses. Therefore, the condenser 44 heats the circulating air through the heat exchange between the refrigerant and the circulating air.

The expansion means 48 expands the refrigerant flowing from the condenser 44 and discharges the refrigerant to the evaporator 45.

A condensation process and a heating process of the circulating air are performed through the heat pump system 43, and the circulating air is flown into the drum 110 again.

Specifically, high temperature and low humidity air heated by the condenser 44 passes through the object to be dried in the drum 110 to become high temperature and high humidity air, is dehumidified passing through the evaporator 45 to become low temperature and low humidity air, and is heated as high temperature and low humidity air by the condenser 44 to be flown into the drum 110.

Meanwhile, between the drum 110 and the evaporator 45, a filter 49 may be provided to remove foreign matters such as lint in the air.

As described above, the clothes dryer 100 is implemented as the heat pump dryer, thereby drying the object to be dried through the components shown in FIG. 4.

Meanwhile, hereinafter, when the clothes dryer 100 includes the configuration shown in FIG. 4, a method of performing the sterilization course will be described in detail with reference to FIGS. 5 to 7.

Figure 5:
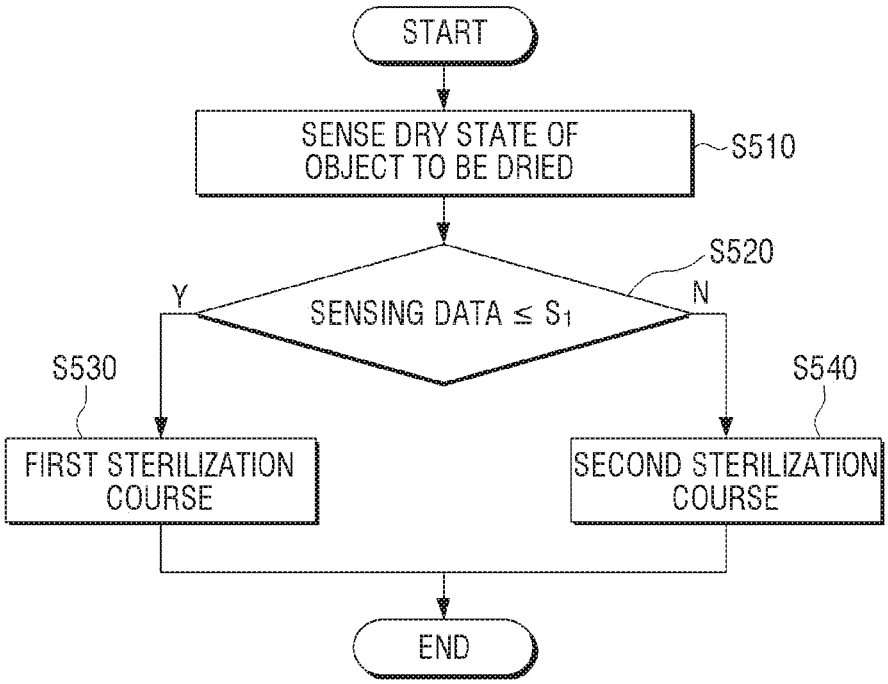
FIGS. 5 to 7 are diagrams illustrating a method for performing a sterilization course in a dry state of an object to be dried according to an embodiment of the disclosure.

First, referring to FIG. 5, the processor 160 may sense a dry state of an object to be dried through the first sensor 120 when the sterilization course on the object to be dried is started (S510).

In this case, a user instruction for the sterilization course may be input through the operator (15-1 in FIG. 1) provided in the clothes dryer 100. For example, a user may input the user instruction for starting the sterilization course by selecting a button provided on the operator 15-1 or rotating an operation dial provided on the operator 15-1.

Accordingly, the processor 160 may start the sterilization course when the user instruction for starting the sterilization course is input.

When the sterilization course starts, the processor 160 may sense the dry state of the object to be dried through the first sensor 120.

Specifically, when the sterilization course starts, the processor 160 may first drive the fan (41 in FIG. 4) and the drum 110, and drive the compressor (46 in FIG. 4) after a predetermined time elapses.

In this case, the processor 160 may drive the compressor 46 so that the operating frequency of the compressor 46 becomes a predetermined value, drive the fan (41 of FIG. 4) and the drum 110 at a predetermined rotation speed, and sense the dry state of the object to be dried.

For example, the processor 160 may drive the fan 41 at a rotation speed of 2890 [rpm]. And, in the case of the compressor 46, the processor 160 may increase the operating frequency of the compressor 46 for a predetermined time, then maintain the increased operating frequency for a certain time, and increase the operating frequency of the compressor 46 until the operating frequency becomes a target operating frequency. Here, the target operating frequency may be, for example, 75 [Hz]. Accordingly, the compressor 46 may be driven at an operating frequency of 75 [Hz].

As such, the processor 160 may proceed with a preprocess, prior to performing a first sterilization course or a second sterilization course, to quickly reach an internal temperature of the drum 110 to a target temperature, thereby increasing the efficiency of drying and sterilization.

Meanwhile, in accordance with a rotation of the drum 110, the object to be dried contained in the drum 110 may be tumbled.

In this case, the first sensor 120 may sense the dry state of the object to be dried based on the magnitude of a current flowing between two electrodes while the object to be dried is tumbled inside the drum 110, and the processor 160 may receive sensed data from the first sensor 120.

Thereafter, the processor 160 may compare the sensed data with a predetermined value (S520), and perform the first sterilization course or the second sterilization course according to a result of comparison (S530, S540).

To this end, a memory (not shown) of the clothes dryer 100 may store a first sterilization algorithm for the first sterilization course and a second sterilization algorithm for the second sterilization course, and the processor 160 may execute the first sterilization algorithm or the second sterilization algorithm according to the dry state of the object to be dried to perform the first sterilization course or the second sterilization course.

Specifically, the processor 160 may compare the sensed data with a predetermined value S1 to determine whether the sensed data is less than or equal to the predetermined value S1.

Here, the predetermined value S1 is a reference value for determining whether the object to be dried is in a dry state or a wet state. Accordingly, when the sensed data is less than or equal to the predetermined value S1, the object to be dried may correspond to the dry state, and when the sensed data is larger than or equal to the predetermined value S1, the object to be dried may correspond to the wet state.

When the sensed data is less than or equal to the predetermined value S1 (S520-Y), the processor 160 may perform sterilization of the object to be dried according to the first sterilization course (S530). When the sensed data is larger than or equal to the predetermined value S1 (S520-N), the processor 160 may perform sterilization of the object to be dried according to the second sterilization course (S540).

For example, when the sensed data is represented by a pulse value, and in a case where the pulse value is less than or equal to 50, the processor 160 may perform sterilization on the object to be dried according to the first sterilization course, and in a case where the pulse value is greater than 50, the processor 160 may perform sterilization on the object to be dried according to the second sterilization course.

As such, the processor 160 may perform different sterilization courses according to the dry state of the object to be dried.

Here, different sterilization courses may include whether to perform a drying process during the sterilization course. That is, the first sterilization course may include a first sterilization process (i.e., the third course), and the second sterilization course may include a drying process (i.e., the first course) and a second sterilization process (i.e., the second course).

Also, sterilization courses that are different from each other may include an internal temperature of the drum 110 for controlling the sterilization course that are different from each other during a sterilization process in a sterilization process for each sterilization course.

Specifically, in the sterilization process, the inside of the drum 110 may be maintained at a predetermined temperature or higher for more than a certain time to sterilize the object to be dried, and the processor 160 may control sterilization courses at temperatures that are different from each other according to a sterilization course determined based on the dry state of the object to be dried, i.e. according to whether the sterilization course is the first sterilization course or the second sterilization course.

That is, the processor 160 may perform a course for sterilizing the object to be dried when the data sensed by the second sensor 130 becomes a first threshold value in the first sterilization course and may perform the course for sterilizing the object to be dried when the data sensed by the second sensor 130 becomes a second threshold value lower than the first threshold value in the second sterilization course.

Hereinafter, it will be described in more detail which process is used to perform a sterilization course on the object to be dried according to each sterilization course.

First, the processor 160 may perform the first sterilization course when the data sensed by the first sensor 120 is less than or equal to a predetermined value. Here, the first sterilization course may include a first sterilization process. That is, when the data sensed by the first sensor 120 is less than or equal to the predetermined value, the processor 160 may perform only the first sterilization process without performing a separate drying process.

Here, that the data sensed by the first sensor 120 is less than or equal to the predetermined value means that the object to be dried corresponds to dry clothes, and thus the first sterilization process may be referred to as a drying sterilization process.

Hereinafter, the first sterilization process will be described in detail with reference to FIG. 6.

Figure 6:
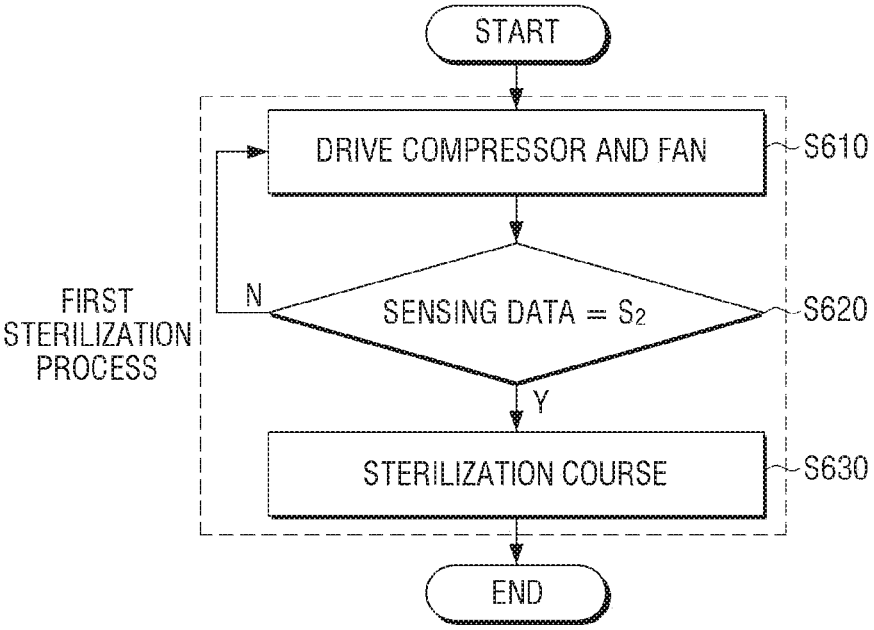

Referring to FIG. 6, the processor 160 may start the first sterilization process when the data sensed by the first sensor 120 is less than or equal to the predetermined value.

First, the processor 160 may drive the compressor 46 according to a predetermined operating frequency and drive the fan 41 at a predetermined rotation speed (S610).

In this case, the processor 160 may control an inverter motor (not shown) driving the compressor 46 to drive the compressor 46 at the predetermined operating frequency, and may control an inverter motor (not shown) driving the fan 41 to drive the fan 41 at the predetermined rotation speed.

Meanwhile, as described above, when the sterilization course starts, the processor 160 may drive the compressor 46 at the predetermined operating frequency and drive the fan 41 at the predetermined rotation speed.

As such, when the compressor 46 and the fan 41 are driven according to the start of the sterilization process, the processor 160 may control driving of the compressor 46 and the fan 41 during the first sterilization process in consideration of driving states of the compressor 46 and the fan 41.

Specifically, the processor 160 may drive the compressor 46, being driven according to the start of the sterilization course at the same operating frequency as before, but may lower the rotation speed of the fan 41. In this case, the processor 160 may control the inverter motor (not shown) driving the fan 41 to lower the rotation speed of the fan 41.

For example, according to the start of the sterilization course, the compressor 46 may be driven at an operating frequency of 75 [Hz], and the fan 41 may be driven at a rotation speed of 2890 [rpm]. In this case, when the processor 160 starts the first sterilization process, the operating frequency of the compressor 46 may be maintained at 75 [Hz], but the rotation speed of the fan 41 may be lowered to 2000 [rpm].

The reason for making the rotation speed slow as above is to raise the temperature in the drum 110 within a short time by reducing the air volume by the fan 41.

When the data sensed by the second sensor 130 reaches the first threshold value (S620-Y) (i.e., sensing data=S2), the processor 160 may maintain the internal temperature of the drum 110 at a third temperature or higher for a predetermined time (S630).

That is, since the internal temperature of the drum 110 gradually increases when the compressor 46 and the fan 41 are driven, a temperature value indicated by the data sensed by the second sensor 130 also gradually increases.

Accordingly, the processor 160 may start the course for sterilizing the object to be dried at a time when the data sensed by the second sensor 130 reaches the first threshold value.

Specifically, to sterilize the object to be dried, the air in the drum 110 should be maintained at a predetermined temperature or higher for more than a certain time. Accordingly, when the data sensed by the second sensor 130 reaches the first threshold value, the processor 160 may control the clothes dryer 100 such that the data sensed by the second sensor 130 for a certain time does not become smaller than the first threshold value, and may control the temperature of the drum 110 to remain at a predetermined temperature or higher for a predetermined time.

Then, when a predetermined time has elapsed, the processor 160 may end the course for sterilizing the object to be dried, and accordingly, the first sterilization process may end.

For example, for sterilization of dry clothes, it is assumed that a condition in which air of 70° C. or higher is maintained in the drum 110 for at least 40 minutes or more is targeted.

Meanwhile, the temperature sensed by the second sensor 130 is lower than the internal temperature of the drum 110 in that the second sensor 130 is disposed outside the drum 110 other than inside the drum 110, for example, in the filter 49, to sense the temperature of the air discharged from the drum 110.

In this case, the processor 160 may start the course for sterilization from a time when the temperature sensed by the second sensor 130 reaches, for example, 59° C., to control the temperature sensed by the second sensor 130 not to be below 59° C. for a certain time.

In this case, the processor 160 may control the temperature sensed by the second sensor 130 not to be below 59° C., for example, for 70 minutes.

According to this method, when the sterilization course is performed, the sterilization quality of the object to be dried may be improved in that the temperature in the drum 110 is maintained at 70° C. or higher for 65 minutes, which satisfies the targeted condition.

Meanwhile, it is described in the above example that the temperature of the air discharged from the drum 110 is sensed and is used to control the internal temperature of the drum 110 for sterilization. However, this is merely an example, and the temperature of the drum 110 may be sensed inside the drum 110 or at a location adjacent the opening 10H of the drum 110 and the processor 160 may control the internal temperature of the drum 110 using the sensed temperature of the drum 110.

Meanwhile, it is described in the above example that the processor 160 starts the course for sterilization when the data sensed by the second sensor 130 reaches the first threshold value. However, this is merely an example, and the processor 160 may start the course for sterilization when the data sensed by the second sensor 130 is greater than or equal to the first threshold value.

Meanwhile, the processor 160 may control the operating frequency of the compressor 46 to control the internal temperature of the drum 110 for the sterilization course.

First, the processor 160 may control the internal temperature of the drum 110 by controlling the operating frequency of the compressor 46 based on the temperature of the compressor 46. Here, the temperature of the compressor 46 may be measured at a valve connected to the compressor 46. To this end, a temperature sensor may be present at the valve connected to the compressor 46.

Specifically, when a user instruction for the sterilization course is input, the compressor 46 is driven, and accordingly, the temperature of the compressor 46 gradually increases.

Also, the internal temperature of the drum 110 gradually increases according to the driving of the compressor 46. The increasing internal temperature of the drum 110 as above may be a minimum temperature (for example, 70° C.) or higher used for sterilization of dry clothes at a time when the temperature of the compressor 46 increases and reaches a predetermined temperature.

Accordingly, when the temperature of the compressor 46 reaches the predetermined temperature, the processor 160 may lower the operating frequency of the compressor 46 by a certain value.

In this case, the processor 160 may sequentially lower the operation frequency of the compressor 46 by the certain value in that the internal temperature of the drum 110 is maintained at a predetermined temperature or higher for sterilization of dry clothes.

That is, even if the operating frequency of the compressor 46 is lowered by the certain value, the internal temperature of the drum 110 has a lower increase than the operating frequency is lowered but gradually increases in that high temperature and low humidity air flows into the drum 110.

Accordingly, the processor 160 may lower the operating frequency of the compressor 46 again by the certain value based on the temperature of the compressor 46 even after lowering the operating frequency by the certain value.

That is, when the temperature of the compressor 46 driven at a lower operating frequency rises to reach a predetermined temperature, the processor 160 may lower the operating frequency of the compressor 46 by the certain value.

As such, the processor 160 may control the internal temperature of the drum 110 by adjusting the operating frequency of the compressor 46.

Thus, the internal temperature of the drum 110 may be maintained at a low increase at the minimum temperature or higher used for sterilization of dry clothes, and may prevent the compressor 46 from being overloaded.

Specifically, based on the data sensed by the second sensor 130, the processor 160 may lower the operating frequency of the compressor 46 by a certain value when the internal temperature of the drum 110 increases by a predetermined value higher than the minimum temperature (for example, 70° C.) used for sterilization of dry clothes.

As a result, the processor 160 may perform the first sterilization process according to the process above.

Meanwhile, the processor 160 may perform the second sterilization course when the data sensed by the first sensor 120 is greater than the predetermined value. Here, the second sterilization course may include a drying process and a second sterilization process. That is, the processor 160 may perform the drying process and the second sterilization process when the data sensed by the first sensor 120 is greater than the predetermined value.

Here, that the sensed data is greater than the predetermined value means that the object to be dried corresponds to wet clothes, and thus the second sterilization process may be referred to as a wet sterilization process.

Hereinafter, referring to FIG. 7, the drying process and the second sterilization process will be described in detail.

Figure 7:
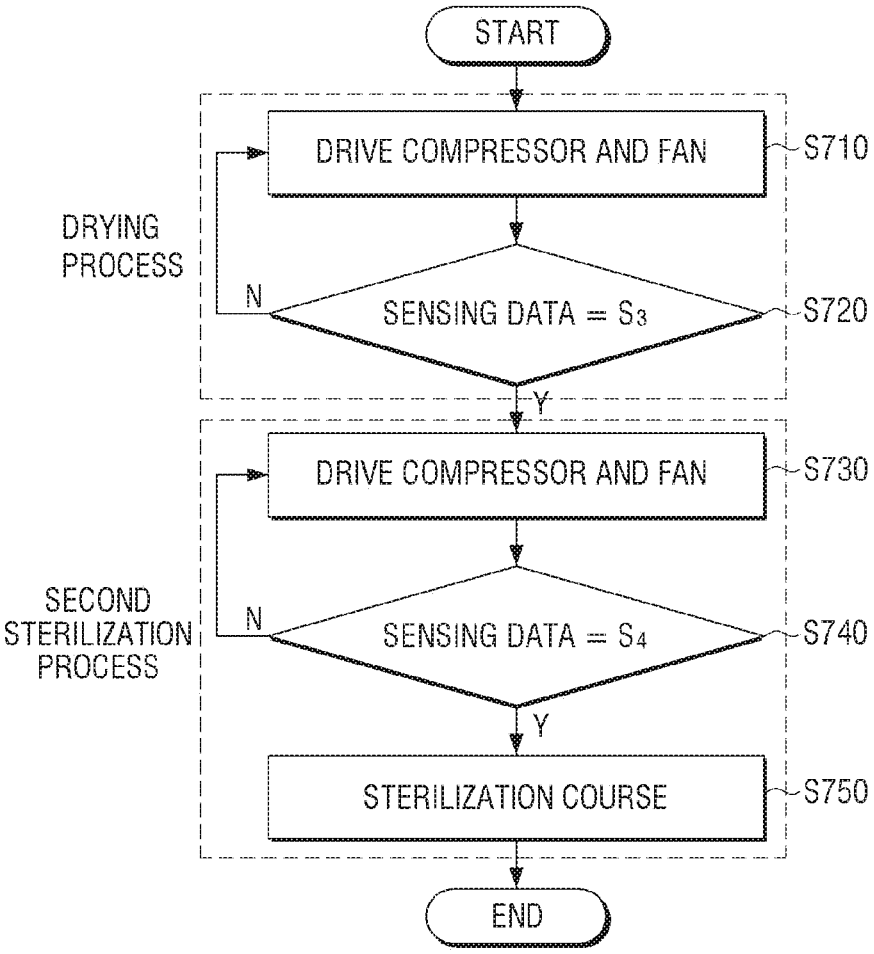

Referring to FIG. 7, the processor 160 may start the drying process when the data sensed by the first sensor 120 is greater than the predetermined value.

Specifically, the processor 160 may start the drying process, drive the compressor 46 according to a predetermined operating frequency, and drive the fan 41 at a predetermined rotation speed (S710).

In this case, the processor 160 may control an inverter motor (not shown) driving the compressor 46 to drive the compressor 46 at the predetermined operating frequency, and an inverter motor (not shown) driving the fan 41 to drive the fan 41 at the predetermined rotation speed.

Meanwhile, as described above, when the sterilization course starts, the processor 160 may drive the compressor 46 at the predetermined operating frequency and drive the fan 41 at the predetermined rotation speed.

As such, when the compressor 46 and the fan 41 are driven according to the start of the sterilization process, the processor 160 may control driving of the compressor 46 and the fan 41 during the drying process in consideration of driving states of the compressor 46 and the fan 41.

Specifically, the processor 160 may drive the compressor 46 being driven according to the start of the sterilization course at the same operating frequency as before, and may drive the fan 41 being driven at the same rotation speed as before.

For example, according to the start of the sterilization course, the compressor 46 may be driven at an operating frequency of 75 [Hz], and the fan 41 may be driven at a rotation speed of 2890 [rpm]. In this case, when the processor 160 starts the drying process, the operating frequency of the compressor 46 may remain the same as before and the rotation speed of the fan 41 may remain the same as before. Accordingly, in the drying process, the operating frequency of the compressor 46 may be 75 [Hz], and the rotating speed of the fan 41 may be 2890 [rpm].

Meanwhile, the processor 160 may control at least one of the fan 41 and the compressor 46 such that the temperature of the air discharged from the drum 110 is equal to or higher than a predetermined temperature based on the data sensed by the second sensor 130.

Here, the predetermined temperature may be lower than the temperature of the air used in the first sterilization process.

For example, as described above, in the first sterilization process, the temperature sensed by the second sensor 130 may be controlled so as not to be lower than 59° C. for a certain time. At this time, the predetermined temperature in the drying process may be lower than, for example, 59° C.

The processor 160 may start the second sterilization process when the data sensed by the first sensor 120 is less than or equal to the predetermined value (S720-Y) (i.e., sensing data=S3) after performing the drying process on the object to be dried.

Here, the predetermined value is a reference value for determining whether the object to be dried is in a dry state or a wet state. Accordingly, when the sensed data is less than or equal to the predetermined value, the object to be dried may correspond to dry clothes, and when the sensed data is equal to or greater than the predetermined value, the object to be dried may correspond to wet clothes.

Accordingly, when the data sensed by the first sensor 120 is less than or equal to the predetermined value, the processor 160 may determine that drying of the object to be dried is completed and end the drying process.

Thereafter, the processor 160 may start the second sterilization process. In this case, in the second sterilization process, the processor 160 may drive the compressor 46 at the predetermined operating frequency and drive the fan 41 at the predetermined rotation speed (S730).

In this case, the processor 160 may control an inverter motor (not shown) driving the compressor 46 to drive the compressor 46 at the predetermined operating frequency, and may control an inverter motor (not shown) driving the fan 41 to drive the fan 41 at the predetermined rotation speed.

Meanwhile, as described above, when the drying process is finished, the compressor 46 is being driven at a specific operating frequency and the fan 41 is being driven at a specific rotation speed. Accordingly, the processor 160 may control driving of the compressor 46 and the fan 41 in the second sterilization process in consideration of driving states of the compressor 46 and the fan 41.

Specifically, the processor 160 drives the compressor 46 in the same manner as the operating frequency of the compressor 46 in the drying process, but may lower the rotation speed of the fan 41. In this case, the processor 160 may control the inverter motor (not shown) driving the fan 41 to lower the rotation speed of the fan 41.

For example, in the drying process, the compressor 46 may be driven at an operating frequency of 75 [Hz], and the fan 41 may be driven at a rotation speed of 2890 [rpm]. In this case, when the processor 160 starts the second sterilization process, the operating frequency of the compressor 46 may be maintained at 75 [Hz], but the rotation speed of the fan 41 may be lowered to 2000 [rpm]. This is to raise the temperature in the drum 110 quickly by reducing the air volume by the fan 41.

As such, the processor 160 may start the second sterilization process and reduce the rotation speed of the fan 41 when the drying process ends.

Thereafter, when the data sensed by the second sensor 130 reaches the second threshold value (S740-Y) (i.e., sensing data=S4), the processor 160 may maintain the temperature of the drum 110 at a second temperature or higher for a predetermined time (S750).

That is, since the internal temperature of the drum 110 gradually increases when the compressor 46 and the fan 41 are driven, the temperature value indicated by the data sensed by the second sensor 130 also gradually increases.

Accordingly, the processor 160 may start the course for sterilizing the object to be dried after the data sensed by the second sensor 130 reaches the second threshold value.

Specifically, to sterilize the object to be dried, the air in the drum 110 should be maintained at a predetermined temperature or higher for more than a certain time. Accordingly, when the data sensed by the second sensor 130 reaches the second threshold value, the processor 160 may control the clothes dryer 100 such that the data sensed by the second sensor 130 for a certain time does not become smaller than the second threshold value and may control the internal temperature of the drum 110 to be maintained at a certain temperature or higher for a certain time.

Then, when a predetermined time has elapsed, the processor 160 may end the course for sterilizing the object to be dried, and accordingly, the second sterilization process may end.

For example, for sterilization of wet clothes, it is assumed that a condition in which air of 60° C. or higher is maintained in the drum 110 for at least 60 minutes or more is targeted.

Meanwhile, the temperature sensed by the second sensor 130 is lower than the internal temperature of the drum 110 in that the second sensor 130 is disposed outside the drum 110 other than inside the drum 110, for example, in the filter 49, to sense the temperature of the air discharged from the drum 110.

In this case, the processor 160 may start the course for sterilization from a time when the temperature sensed by the second sensor 130 reaches, for example, 56° C., to control the temperature sensed by the second sensor 130 not to be below 56° C. for a certain time.

Here, the processor 160 may control the temperature sensed by the second sensor 130 not to be below 56° C., for example, for 70 minutes.

According to this method, when the sterilization course is performed, the sterilization quality of the object to be dried may be improved in that the temperature in the drum 110 is maintained at 60° C. or higher for 75 minutes, which satisfies the targeted condition.

Meanwhile, it is described in the above example that the temperature of the air discharged from the drum 110 is sensed and is used to control the internal temperature of the drum 110 for sterilization. However, this is merely an example, and the temperature of the drum 110 may be sensed inside the drum 110 or at a location adjacent the opening 10H of the drum 110 and the processor 160 may control the internal temperature of the drum 110 using the sensed temperature of the drum 110.

Meanwhile, it is described in the above example that the processor 160 starts the course for sterilization when the data sensed by the second sensor 130 reaches the second threshold value. However, this is merely an example, and the processor 160 may start the course for sterilization when the data sensed by the second sensor 130 is greater than or equal to the second threshold value.

Meanwhile, the processor 160 may control the operating frequency of the compressor 46 to control the internal temperature of the drum 110 for the sterilization course.

First, the processor 160 may control the internal temperature of the drum 110 by controlling the operating frequency of the compressor 46 based on the temperature of the compressor 46. Here, the temperature of the compressor 46 may be measured at a valve connected to the compressor 46. To this end, a temperature sensor may be present at the valve connected to the compressor 46.

Specifically, when a user instruction for the sterilization course is input, the compressor 46 is driven, and accordingly, the temperature of the compressor 46 gradually increases.

Also, the internal temperature of the drum 110 gradually increases according to the driving of the compressor 46. The increasing internal temperature of the drum 110 as above may be a minimum temperature (for example, 60° C.) or higher used for sterilization of dry clothes at a time when the temperature of the compressor 46 increases and reaches a predetermined temperature.

Accordingly, when the temperature of the compressor 46 reaches the predetermined temperature, the processor 160 may lower the operating frequency of the compressor 46 by a certain value.

In this case, the processor 160 may sequentially lower the operation frequency of the compressor 46 by the certain value in that the internal temperature of the drum 110 is maintained at a predetermined temperature or higher for sterilization of dry clothes.

That is, even if the operating frequency of the compressor 46 is lowered by the certain value, the internal temperature of the drum 110 has a lower increase than the operating frequency is lowered but gradually increases in that high temperature and low humidity air flows into the drum 110.

Accordingly, the processor 160 may lower the operating frequency of the compressor 46 again by the certain value based on the temperature of the compressor 46 even after lowering the operating frequency by the certain value.

That is, when the temperature of the compressor 46 driven at a lower operating frequency rises to reach a predetermined temperature, the processor 160 may lower the operating frequency of the compressor 46 by the certain value.

As such, the processor 160 may control the internal temperature of the drum 110 by adjusting the operating frequency of the compressor 46.

Thus, the internal temperature of the drum 110 may be maintained at a low increase at the minimum temperature or higher used for sterilization of dry clothes, and may prevent the compressor 46 from being overloaded.

Also, the processor 160 may control the internal temperature of the drum 110 by controlling the operating frequency of the compressor 46 based on the data sensed by the second sensor 130.

Specifically, based on the data sensed by the second sensor 130, the processor 160 may lower the operating frequency of the compressor 46 by a certain value when the internal temperature of the drum 110 increases by a predetermined value higher than the minimum temperature (for example, 60° C.) used for sterilization of dry clothes.

As a result, the processor 160 may perform the drying process and the second sterilization process according to the process above.

Meanwhile, it is described in the above-described example that the drying process and the second sterilization process are performed, but this is merely an example.

That is, the processor 160 may control proceeding of the second sterilization process in consideration of the progress of the drying process.

For example, the processor 160 may not additionally perform the second sterilization process when the internal temperature of the drum 110 is maintained at a temperature targeted for the sterilization course or higher for more than a certain time during the drying process.

Also, the processor 160 may perform a sterilization course in the second sterilization process only as additional time as necessary when the internal temperature of the drum 110 reaches or exceeds the temperature targeted for the sterilization course but is not maintained for more than the certain time during the drying process.

The processor 160 may maintain the internal temperature of the drum 110 at the temperature targeted for the sterilization course or higher for more than the certain time through the second sterilization process when the internal temperature of the drum 110 does not reach the temperature targeted for the sterilization course during the drying process.

Meanwhile, as described above, during the sterilization course, the processor 160 may maintain the internal temperature of the drum 110 at a third temperature or higher for a certain time in the first sterilization process, and may maintain the internal temperature of the drum 110 at the second temperature or higher for a certain time in the second sterilization process.

In this case, the third temperature may be different from the second temperature, and specifically, the third temperature may be higher than the second temperature. For example, the first temperature may be 59° C. and the second temperature may be 56° C.

Thus, the temperature at which the sterilization course is controlled in the first sterilization process is higher than the temperature at which the sterilization course is controlled in the second sterilization process has the following reasons.

Specifically, the first sterilization process is performed when the object to be dried is dry clothes, whereas the second sterilization process is performed when the object to be dried is wet clothes. Therefore, humid air is present in the drum 110 in the second sterilization process, compared to the first sterilization process, and the heat transfer rate is increased by the humid air. Consequently, even if a temperature for the sterilization course in the second sterilization process is set to be lower than a temperature for the sterilization course in the first sterilization process, a target sterilization effect may be obtained. As described above, the energy efficiency in the sterilization course may be improved in that the temperature for the sterilization course is set differently according to whether the object to be dried is dry clothes or wet clothes.

Meanwhile, with reference to FIGS. 8 to 11, a method of performing the sterilization course when the clothes dryer 100 is implemented as a hybrid heat pump dryer.

FIG. 8 is a diagram illustrating a configuration of the clothes dryer 100 according to an embodiment of the disclosure.

A fan 81 generates a flow of air as it rotates. In this case, the rotation speed of the fan 81 may be varied under the control of an inverter motor (or a motor) (not shown) in that the fan 81 is driven in accordance with the inverter motor (not shown).

Air is circulated through a flow path 82 in accordance with the rotation of the fan 81 so that the air may be flown into and discharged from the drum 110.

In this case, to dry an object to be dried contained in the drum 110, the air discharged from the drum 110 may be flown into the drum 110 again through condensation and heating processes.

That is, the flow path 82 is a circulation path of the air discharged from the drum 110 and flown into the drum 110. The fan 81 discharges the air from the drum 110 through rotation to circulate the air through the flow path 82.

Meanwhile, the clothes dryer 100 may include a heat pump system 83 condensing and heating air through a refrigerant.

In this case, the refrigerant circulates in the order of an evaporator 85, a compressor 86, a condenser 84, and an expansion means 88 through a refrigerant pipe 87.

Specifically, in the evaporator 85, the refrigerant absorbs heat and evaporates. Accordingly, the evaporator 85 cools the circulating air through the heat exchange between the refrigerant and the circulating air to condense moisture. In this case, the condensed moisture may be discharged to the outside of the clothes dryer 100 through a pipe (not shown).

Meanwhile, the compressor 86 compresses the refrigerant flowing from the evaporator 85 and discharges the refrigerant to the condenser 84. In this case, the rotation speed of the compressor 86 may be varied under the control of an inverter motor (or a motor) (not shown) in that the compressor 86 is driven in accordance with the inverter motor (not shown). That is, the operating frequency (or driving frequency) of the compressor 86 may be varied.

In the condenser 84, the refrigerant emits heat and condenses. Thus, the condenser 84 heats the circulating air through the heat exchange between the refrigerant and the circulating air.

The expansion means 88 expands the refrigerant flowing from the condenser 84 and discharges the refrigerant to the evaporator 85.

As such, the condensation process and the heating process of the circulating air are performed through the heat pump system 83, and the circulating air is flown into the drum 110 again.

Specifically, high temperature and low humidity air heated by the condenser 84 passes through the object to be dried in the drum 110 to become high temperature and high humidity air, is dehumidified while passing through the evaporator 85, to become low temperature and low humidity air, and is heated as high temperature and low humidity air by the condenser 84 to be flown into the drum 110.

Also, the heater 90 may heat the air flown into the drum 110 through the flow path 82.

That is, the heater 90 may supply the air heated by the heater 90 to the drum 110 through the condenser 84.

Meanwhile, between the drum 110 and the evaporator 85, a filter 89 may be provided to remove foreign matters such as lint in the air.

As described above, the clothes dryer 100 is implemented as a hybrid heat pump dryer, thereby drying the object to be dried through the components shown in FIG. 8. Here, since the clothes dryer 100 has two heat sources, that is, the heat pump system 83 and the heater 90, the clothes dryer 100 is referred to as the hybrid heat pump dryer.

Meanwhile, hereinafter, when the clothes dryer 100 includes the configuration shown in FIG. 8, a method of performing the sterilization course will be described in detail with reference to FIGS. 9 to 11.

Figure 9:
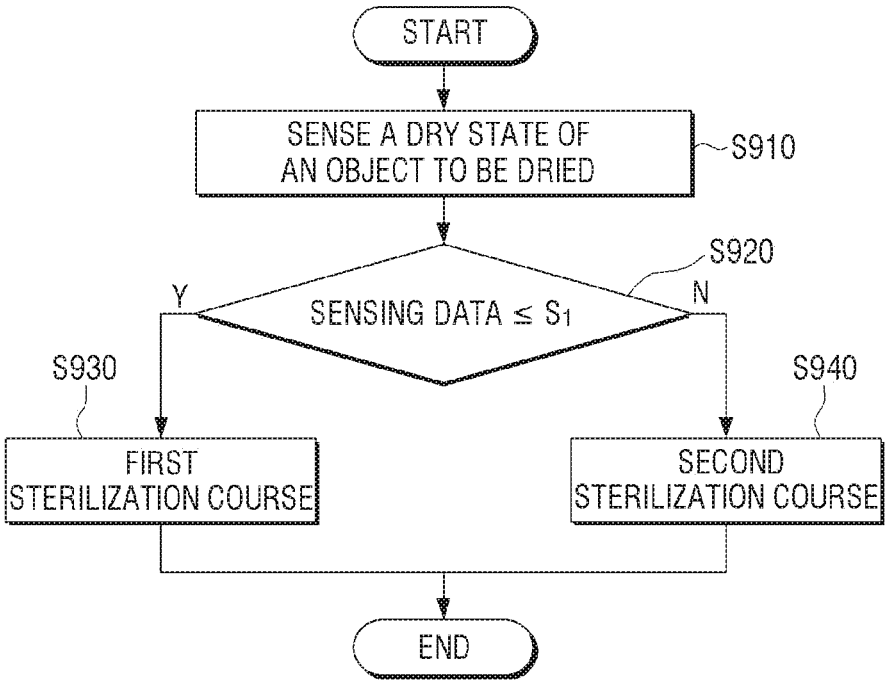
FIGS. 9 to 11 are diagrams illustrating a method for performing a sterilization course in a dry state of an object to be dried according to an embodiment of the disclosure.

First, referring to FIG. 9, the processor 160 may sense a dry state of the object to be dried through the first sensor 120 when a sterilization course on the object to be dried starts (S910).

In this case, a user instruction for the sterilization course may be input through the operator (15-1 in FIG. 1) provided in the clothes dryer 100. For example, a user may input the user instruction for starting the sterilization course by selecting a button provided on the operator 15-1 or rotating an operation dial provided on the operator 15-1.

Accordingly, the processor 160 may start the sterilization course when the user instruction for starting the sterilization course is input.

When the sterilization course starts, the processor 160 may sense the dry state of the object to be dried through the first sensor 120.

Specifically, when the sterilization course starts, the processor 160 may first drive the fan (81 in FIG. 8) and the drum 110, when a certain time has elapsed, drive the compressor (86 in FIG. 8), and drive the heater (90 in FIG. 8).

That is, the processor 160 may turn on the heater 90, drive the compressor 86 so that the operating frequency of the compressor 86 has a predetermined value, drive the fan 81 and the drum 110 at a predetermined rotation speed, and sense the dry state of the object to be dried.

For example, the processor 160 may drive the fan 81 at a rotation speed of 2890 [rpm]. And, in the case of the compressor 86, the processor 160 may increase the operating frequency of the compressor 86 for a predetermined time, then maintain the increased operating frequency for a certain time, and increase the operating frequency of the compressor 86 until the operating frequency becomes a target operating frequency. Here, the target operating frequency may be, for example, 75 [Hz]. Accordingly, the compressor 86 may be driven at an operating frequency of 75 [Hz].

As such, the processor 160 may proceed with a preprocess, prior to performing a first sterilization course or a second sterilization course, to quickly reach an internal temperature of the drum 110 to a target temperature, thereby increasing the efficiency of drying and sterilization.

Meanwhile, in accordance with the rotation of the drum 110, the object to be dried contained in the drum 110 may be tumbled.

In this case, the first sensor 120 may sense the dry state of the object to be dried based on the magnitude of a current flowing between the two electrodes while the object to be dried is tumbled inside the drum 110, and the processor 160 may receive sensed data from the first sensor 120.

Thereafter, the processor 160 may compare the sensed data with a predetermined value (S920), and may perform the first sterilization course or the second sterilization course according to a result of comparison (S930, S940).

To this end, a memory (not shown) of the clothes dryer 100 may store a first sterilization algorithm for the first sterilization course and a second sterilization algorithm for the second sterilization course, and the processor 160 may execute the first sterilization algorithm or the second sterilization algorithm according to the dry state of the object to be dried to perform the first sterilization course or the second sterilization course.

Specifically, the processor 160 may compare the sensed data with a predetermined value S5 to determine whether the sensed data is less than or equal to the predetermined value S5.

Here, the predetermined value S5 is a reference value for determining whether the object to be dried is in a dry state or a wet state. Accordingly, when the sensed data is less than or equal to the predetermined value S5, the object to be dried may correspond to the dry state, and when the sensed data is larger than or equal to the predetermined value S5, the object to be dried may correspond to the wet state.

When the sensed data is less than equal to the predetermined value S5 (S920—Y), the processor 160 may perform sterilization of the object to be dried according to the first sterilization course (S930). When the sensed data is larger than or equal to the predetermined value S5 (S920-N), the processor 160 may perform sterilization of the object to be dried according to the second sterilization course (S940).

For example, when the sensed data is represented by a pulse value, and in a case where the pulse value is less than or equal to 50, the processor 160 may perform sterilization on the object to be dried according to the first sterilization course, and in a case where the pulse value is greater than 50, the processor 160 may perform sterilization on the object to be dried according to the second sterilization course.

As such, the processor 160 may perform different sterilization courses according to the dry state of the object to be dried.

Here, different sterilization courses may include whether to perform a drying process during the sterilization course. That is, the first sterilization course may include a first sterilization process (i.e., a third course), and the second sterilization course may include a drying process (i.e., a first course) and a second sterilization process (i.e., a second course).

Also, sterilization courses that are different from each other may include an internal temperature of the drum 110 for controlling the sterilization course that are different from each other during a sterilization process in a sterilization process for each sterilization course.

Specifically, in the sterilization process, the inside of the drum 110 may be maintained at a predetermined temperature or higher for more than a certain time to sterilize the object to be dried, and the processor 160 may control sterilization courses at temperatures that are different from each other according to a sterilization course determined based on the dry state of the object to be dried, i.e. according to whether the sterilization course is the first sterilization course or the second sterilization course.

That is, the processor 160 may perform a course for sterilizing the object to be dried when the data sensed by the second sensor 130 becomes a first threshold value in the first sterilization course and may perform the course for sterilizing the object to be dried when the data sensed by the second sensor 130 becomes a second threshold value lower than the first threshold value in the second sterilization course.

Hereinafter, it will be described in more detail which process is used to perform a sterilization course on the object to be dried according to each sterilization course.

First, the processor 160 may perform the first sterilization course when the data sensed by the first sensor 120 is less than or equal to a predetermined value. Here, the first sterilization course may include a first sterilization process. That is, when the data sensed by the first sensor 120 is less than or equal to the predetermined value, the processor 160 may perform only the first sterilization process without performing a separate drying process.

Here, that the data sensed by the first sensor 120 is less than or equal to the predetermined value means that the object to be dried corresponds to dry clothes, and thus the first sterilization process may be referred to as a drying sterilization process.

Hereinafter, the first sterilization process will be described in detail with reference to FIG. 10.

Figure 10:
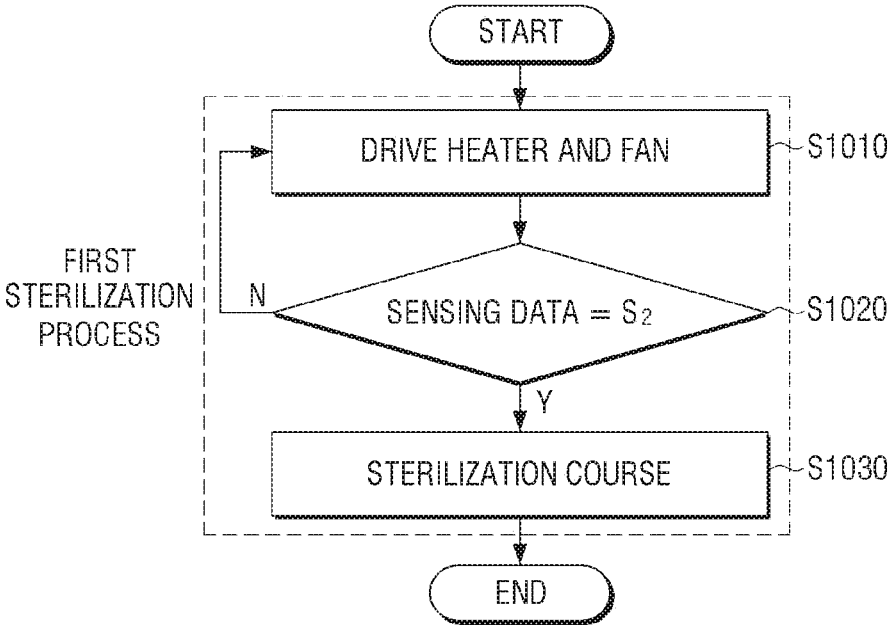

Referring to FIG. 10, the processor 160 may start the first sterilization process when the data sensed by the first sensor 120 is less than or equal to the predetermined value.

Specifically, the processor 160 may drive the heater 90, turn off the compressor 86, and drive the fan 81 at a predetermined rotation speed (S1010).

As described above, when the sterilization course starts, the processor 160 may drive the heater 90, drive the compressor 86 at a predetermined operating frequency, and drive the fan 81 at a predetermined rotation speed.

When the compressor 86, the fan 81 and the heater 90 are driven in accordance with the start of the sterilization course, the processor 160 may control driving of the compressor 86, the fan 81, and the heater 90 in the first sterilization process in consideration of driving states of the compressor 86, the fan 81, and the heater 90.

Specifically, the processor 160 turns off the compressor 86 being driven according to the start of the sterilization course, but may continue to drive the heater 90. Then, the processor 160 may reduce the rotation speed of the fan 81. In this case, the processor 160 may control an inverter motor (not shown) driving the fan 81 to lower the rotation speed of the fan 81.

For example, the fan 81 may be driven at a rotation speed of 2700 [rpm] in accordance with the start of the sterilization course. In this case, when the processor 160 starts the first sterilization process, the rotation speed of the fan 81 may be lowered to 2000 [rpm].

The reason for making the rotation speed slow as above is to raise the temperature in the drum 110 within a short time by reducing the air volume by the fan 81.

Thereafter, when the data sensed by the second sensor 130 reaches the first threshold value (S1020-Y) (i.e., sensing data=S6), the processor 160 maintain the temperature of the drum 110 at a third temperature or higher for a predetermined time through on/off of the heater 90 (S1030).

That is, since the internal temperature of the drum 110 gradually increases when the heater 90 and the fan 81 are driven, a temperature value indicated by the data sensed by the second sensor 130 also gradually increases.

Accordingly, the processor 160 may start the course for sterilizing the object to be dried at a time when the data sensed by the second sensor 130 reaches the first threshold value.

Specifically, to sterilize the object to be dried, the air in the drum 110 should be maintained at a predetermined temperature or higher for more than a certain time. Accordingly, when the data sensed by the second sensor 130 reaches the first threshold value, the processor 160 may control the clothes dryer 100 such that the data sensed by the second sensor 130 for a certain time does not become smaller than the first threshold value, and may control the internal temperature of the drum 110 to remain at a predetermined temperature or higher for a predetermined time.

In this case, the processor 160 may control on/off of the heater 90 to control the temperature of the air in the drum 110 in that the heater 90 heats the air flown into the drum 110.

Specifically, the processor 160 may turn on or off the heater 90 such that the temperature of the air of the drum 110 is within a predetermined threshold range, based on the data sensed by the second sensor 130, to control the internal temperature of the drum 110 to remain at the predetermined temperature or higher.

That is, the processor 160 may turn off the heater 90 when the temperature of the air of the drum 110 gradually increases to reach the predetermined threshold value in accordance with the driving of the heater 90, and may turn on the heater 90 when the heater 90 is turned off such that the temperature of the air in the drum 110 gradually decreases to reach the predetermined threshold value.

Then, when a predetermined time has elapsed, the processor 160 may end the course for sterilizing the object to be dried, and accordingly, the first sterilization process may end.

For example, for sterilization of dry clothes, it is assumed that a condition in which air of 70° C. or higher is maintained in the drum 110 for at least 40 minutes or more is targeted.

Meanwhile, the temperature sensed by the second sensor 130 is lower than the internal temperature of the drum 110 when the second sensor 130 is disposed outside the drum 110 other than inside the drum 110, for example, in the filter 89, to sense the temperature of the air discharged from the drum 110.

In this case, the processor 160 may start a process for sterilization from a time when the temperature sensed by the second sensor 130 reaches 59° C., when the internal temperature of the drum 110 gradually increases in accordance with the driving of the heater 90 and thus the temperature of the air discharged from the drum 110 increases to 71° C., the processor 160 may turn off the heater 90, and after the heater 90 is turned off, when the internal temperature of the drum 110 gradually decreases and thus the temperature of the air discharged from the drum 110 increases to 68° C., the processor 160 may turn on the heater 90. At this time, the processor 160 may perform this process for approximately 70 minutes.

According to this method, when the sterilization course is performed, the sterilization quality of the object to be dried may be improved in that the temperature in the drum 110 is maintained at 70° C. or higher for 65 minutes, which satisfies the targeted condition.

Meanwhile, it is described in the above example that the temperature of the air discharged from the drum 110 is sensed and is used to control the internal temperature of the drum 110 for sterilization. However, this is merely an example, and the temperature of the drum 110 may be sensed inside the drum 110 or at a location adjacent the opening 10H of the drum 110 and the processor 160 may control the internal temperature of the drum 110 using the sensed temperature of the drum 110.

Meanwhile, it is described in the above example that the processor 160 starts the course for sterilization when the data sensed by the second sensor 130 reaches the first threshold value. However, this is merely an example, and the processor 160 may start the course for sterilization when the data sensed by the second sensor 130 is greater than or equal to the first threshold value.

As a result, the processor 160 may perform the first sterilization process according to the above process.

Meanwhile, the processor 160 may perform the second sterilization course when the data sensed by the first sensor 120 is greater than the predetermined value. Here, the second sterilization course may include a drying process and a second sterilization process. That is, the processor 160 may perform the drying process and the second sterilization process when the data sensed by the first sensor 120 is greater than the predetermined value.

Here, that the sensed data is greater than the predetermined value means that the object to be dried corresponds to wet clothes, and thus the second sterilization process may be referred to as a wet sterilization process.

Hereinafter, referring to FIG. 11, the drying process and the second sterilization process will be described in detail.

Figure 11:
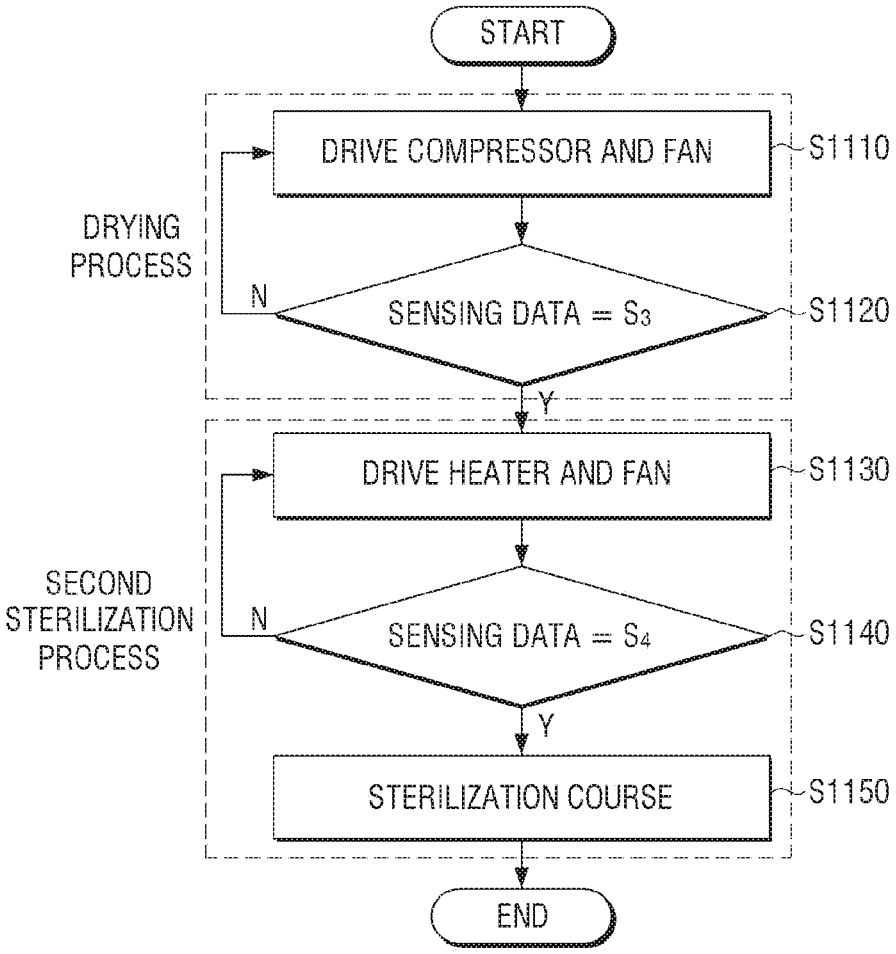

Referring to FIG. 11, the processor 160 may start the drying process when the data sensed by the first sensor 120 is greater than the predetermined value.

Specifically, the processor 160 may start the drying process, drive the compressor 86 according to a predetermined operating frequency, and drive the fan 81 at a predetermined rotation speed (S1110).

In this case, the processor 160 may control an inverter motor (not shown) driving the compressor 86 to drive the compressor 86 at the predetermined operating frequency, and an inverter motor (not shown) driving the fan 81 to drive the fan 81 at the predetermined rotation speed.

Meanwhile, as described above, when the sterilization course starts, the processor 160 may drive the heater 90, drive the compressor 86 at the predetermined operating frequency, and drive the fan 81 at the predetermined rotation speed.

As such, when the compressor 86, the fan 81, and the heater 90 are driven according to the start of the sterilization process, the processor 160 may control driving of the compressor 86, the fan 81, and the heater 90 during the drying process in consideration of driving states of the compressor 86, the fan 81, and the heater 90.

Specifically, the processor 160 may drive the compressor 86 being driven according to the start of the sterilization course at the same operating frequency as before, and may drive the fan 81 being driven at the same rotation speed as before.

For example, according to the start of the sterilization course, the compressor 86 may be driven at an operating frequency of 65 [Hz], and the fan 81 may be driven at a rotation speed of 2700 [rpm]. In this case, when the processor 160 starts the drying process, the operating frequency of the compressor 86 may remain the same as before and the rotation speed of the fan 81 may remain the same as before. Accordingly, in the drying process, the operating frequency of the compressor 86 may be 65 [Hz], and the rotating speed of the fan 81 may be 2700 [rpm].

Meanwhile, since the compressor 86, the fan 81, and the heater 90 are driven, the temperature of the drum 110 may gradually increase.

In this case, the processor 160 may turn off the heater 90 when the temperature of the drum 110 sensed by the second sensor 130 reaches a predetermined temperature. That is, the processor 160 may turn off the heater 90 when the temperature of the drum 110 reaches the predetermined temperature during the drying process. However, this is only an example, and the driving of the heater 90 may be maintained.

Meanwhile, the processor 160 may control at least one of the compressor 86, the fan 81, and the heater 90 such that the temperature of the air discharged from the drum 110 is equal to or higher than the predetermined temperature based on the data sensed by the second sensor 130.

Here, the predetermined temperature may be lower than the temperature of air used in the first sterilization process.

For example, as described above, in the first sterilization process, the temperature sensed by the second sensor 130 may be controlled so as not to be lower than 59° C. for a certain time. At this time, the predetermined temperature in the drying process may be lower than, for example, 59° C.

The processor 160 may start the second sterilization process when the data sensed by the first sensor 120 is less than or equal to the predetermined value (S1120-Y) (i.e., sensing data=S7) after performing the drying process on the object to be dried.

Here, the predetermined value is a reference value for determining whether the object to be dried is in a dry state or a wet state. Accordingly, when the sensed data is less than or equal to the predetermined value, the object to be dried may correspond to dry clothes, and when the sensed data is equal to or greater than the predetermined value, the object to be dried may correspond to wet clothes.

Accordingly, when the data sensed by the first sensor 120 is less than or equal to the predetermined value, the processor 160 may determine that drying of the object to be dried is completed and end the drying process.

Thereafter, the processor 160 may start the second sterilization process. In this case, in the second sterilization process, the processor 160 may drive the heater 90, turn off the compressor 86, and drive the fan 81 at the predetermined rotation speed (S1130).

In this case, the processor 160 may control an inverter motor (not shown) driving the fan 81 to drive the fan 81 at the predetermined rotation speed.

Meanwhile, as described above, when the drying process is finished, the heater 90 is in an off state, the compressor 86 is being driven at a specific operating frequency, and the fan 81 is being driven at a specific rotation speed. Accordingly, the processor 160 may control driving of the compressor 86, the fan 81, and the heater 90 in the second sterilization process in consideration of driving states of the compressor 86, the fan 81, and the heater 90.

Specifically, the processor 160 turns off the compressor 86 that is being driven, but may turn on the heater 90. Then, the processor 160 may reduce the rotation speed of the fan 81. In this case, the processor 160 may control an inverter motor (not shown) driving the fan 81 to lower the rotation speed of the fan 81.

For example, in the drying process, the fan 81 may be driven at a rotation speed of 2700 [rpm]. In this case, when the processor 160 starts the second sterilization process, the rotation speed of the fan 81 may be lowered to 2000 [rpm]. This is to raise the temperature in the drum 110 in a short time by reducing the air volume by the fan 81.

As such, when the drying process ends, the processor 160 may start the second sterilization process, turn off the compressor 86, turn on the heater 90, and reduce the rotation speed of the fan 81.

Thereafter, when the data sensed by the second sensor 130 reaches the second threshold value (S1140-Y) (i.e., sensing data=S8), the processor 160 may maintain the temperature of the drum 110 at a second temperature or higher for a predetermined time through on/off of the heater 90 (S1150).

That is, since the internal temperature of the drum 110 gradually increases when the heater 90 and the fan 81 are driven, the temperature value indicated by the data sensed by the second sensor 130 also gradually increases.

Accordingly, the processor 160 may start the course for sterilizing the object to be dried after the data sensed by the second sensor 130 reaches the second threshold value.

Specifically, to sterilize the object to be dried, the air in the drum 110 should be maintained at a predetermined temperature or higher for more than a certain time. Accordingly, when the data sensed by the second sensor 130 reaches the second threshold value, the processor 160 may control the clothes dryer 100 such that the data sensed by the second sensor 130 for a certain time does not become smaller than the second threshold value and may control the internal temperature of the drum 110 to be maintained at a certain temperature or higher for a certain time.

In this case, the processor 160 may control on/off of the heater 90 to control the temperature of the air in the drum 110 in that the heater 90 heats the air flown into the drum 110.

Specifically, the processor 160 may turn on or off the heater 90 such that the temperature of the air of the drum 110 is within a predetermined threshold range, based on the data sensed by the second sensor 130, to control the internal temperature of the drum 110 to remain at the predetermined temperature or higher.

That is, the processor 160 may turn off the heater 90 when the temperature of the air of the drum 110 gradually increases to reach the predetermined threshold value in accordance with the driving of the heater 90, and may turn on the heater 90 when the heater 90 is turned off such that the temperature of the air in the drum 110 gradually decreases to reach the predetermined threshold value.

Then, when a predetermined time has elapsed, the processor 160 may end the course for sterilizing the object to be dried, and accordingly, the first sterilization process may end.

For example, for sterilization of wet clothes, it is assumed that a condition in which air of 60° C. or higher is maintained in the drum 110 for at least 60 minutes or more is targeted.

Meanwhile, the temperature sensed by the second sensor 130 is lower than the internal temperature of the drum 110 when the second sensor 130 is disposed outside the drum 110 other than inside the drum 110, for example, in the filter 89, to sense the temperature of the air discharged from the drum 110.

In this case, the processor 160 may start a course for sterilization from a time when the temperature sensed by the second sensor 130 reaches 56° C., when the internal temperature of the drum 110 gradually increases in accordance with the driving of the heater 90 and thus the temperature of the air discharged from the drum 110 increases to 71° C., the processor 160 may turn off the heater 90, and after the heater 90 is turned off, when the internal temperature of the drum 110 gradually decreases and thus the temperature of the air discharged from the drum 110 increases to 68° C., the processor 160 may turn on the heater 90. At this time, the processor 160 may perform this process for approximately 70 minutes.

According to this method, when the sterilization course is performed, the sterilization quality of the object to be dried may be improved in that the temperature in the drum 110 is maintained at 60° C. or higher for 75 minutes, which satisfies the targeted condition.

Meanwhile, it is described in the above example that the temperature of the air discharged from the drum 110 is sensed and is used to control the internal temperature of the drum 110 for sterilization. However, this is merely an example, and the temperature of the drum 110 may be sensed inside the drum 110 or at a location adjacent the opening 10H of the drum 110 and the processor 160 may control the internal temperature of the drum 110 using the sensed temperature of the drum 110.

Meanwhile, it is described in the above example that the processor 160 starts the course for sterilization when the data sensed by the second sensor 130 reaches the second threshold value. However, this is merely an example, and the processor 160 may start the course for sterilization when the data sensed by the second sensor 130 is greater than or equal to the second threshold value.

As a result, the processor 160 may perform the drying process and the second sterilization process according to the above process.

Meanwhile, it is described in the above-described example that the drying process and the second sterilization process are performed, but this is merely an example.

That is, the processor 160 may control proceeding of the second sterilization process in consideration of the progress of the drying process.

For example, the processor 160 may not additionally perform the second sterilization process when the internal temperature of the drum 110 is maintained at a temperature targeted for the sterilization course or higher for more than a certain time during the drying process.

Also, the processor 160 may perform a sterilization course in the second sterilization process only as additional time as necessary when the internal temperature of the drum 110 reaches or exceeds the temperature targeted for the sterilization course but is not maintained for more than the certain time during the drying process.

The processor 160 may maintain the internal temperature of the drum 110 at the temperature targeted for the sterilization course or higher for more than the certain time through the second sterilization process when the internal temperature of the drum 110 does not reach the temperature targeted for the sterilization course during the drying process.

Meanwhile, as described above, during the sterilization course, the processor 160 may maintain the internal temperature of the drum 110 at a third temperature or higher for a certain time in the first sterilization process, and may maintain the internal temperature of the drum 110 at the second temperature or higher for a certain time in the second sterilization process.

In this case, the third temperature may be different from the second temperature, and specifically, the third temperature may be higher than the second temperature. For example, the third temperature may be 59° C. and the second temperature may be 56° C.

Thus, the temperature at which the sterilization course is controlled in the first sterilization process is higher than the temperature at which the sterilization course is controlled in the second sterilization process has the following reasons.

Specifically, the first sterilization process is performed when the object to be dried is dry clothes, whereas the second sterilization process is performed when the object to be dried is wet clothes. Therefore, humid air is present in the drum 110 in the second sterilization process, compared to the first sterilization process, and the heat transfer rate is increased by the humid air. Consequently, even if a temperature for the sterilization course in the second sterilization process is set to be lower than a temperature for the sterilization course in the first sterilization process, a target sterilization effect may be obtained. As described above, the energy efficiency in the sterilization course may be improved in that the temperature for the sterilization course is set differently according to whether the object to be dried is dry clothes or wet clothes.

In addition, power consumption may be minimized in that an operation of a compressor is stopped in the sterilization process and heating is performed only with a heater. Thus, efficient sterilization may be performed even when the clothes dryer 100 is installed in a low temperature environment in that a heater relatively strong in the surrounding environment is used.

Meanwhile, the processor 160 may perform a cooling process when the first sterilization process (i.e., the third course) or the second sterilization process (i.e., the second course) ends.

In this case, the rotation speed of a fan in the cooling process may be higher than the rotation speed of the fan in the first and second sterilization processes.

As described above, when the first sterilization course or the second sterilization course ends, the compressor 46 is being driven at a specific operating frequency, and the fan 41 is being driven at a specific rotation speed.

Accordingly, the processor 160 may control driving of the compressor 46 and the fan 41 in the cooling process in consideration of driving states of the compressor 46 and the fan 41.

Specifically, the processor 160 may stop driving of the compressor 46 and increase the rotation speed of the fan 41. In this case, the processor 160 may control an inverter motor (not shown) driving the fan 41 to increase the rotation speed of the fan 41.

For example, in the first sterilization process or the second sterilization process, the fan 41 may be driven at a rotation speed of 2000 [rpm]. In this case, when the processor 160 starts the cooling process, the rotation speed of the fan 41 may be increased to 2890 [rpm]. This is to lower the temperature in the drum 110 quickly by increasing the air volume by the fan 41.

Thereafter, the processor 160 may end the cooling process when the data sensed by the second sensor 130 reaches a threshold value. Thus, the entire sterilization course may end.

That is, since the internal temperature of the drum 110 gradually decreases in accordance with driving of the fan 41, a temperature value indicated by the data sensed by the second sensor 130 also gradually decreases.

Accordingly, when the data sensed by the second sensor 130 reaches the threshold value, the processor 160 may stop driving of the fan 41, the drum 110, and the like that are being driven and end the cooling process.

In this case, when the temperature value indicated by the data sensed by the second sensor 130 is 54° C., the processor 160 may end the cooling process.

Meanwhile, as described above, when the first sterilization course or the second sterilization course ends, the heater 90 is being driven, and the fan 81 is driven at a specific rotation speed.

Accordingly, the processor 160 may control driving of the heater 90 and the fan 81 in the cooling process in consideration of driving state of the heater 90 and the fan 81.

Specifically, the processor 160 may stop driving the heater 90 and increase the rotation speed of the fan 81. In this case, the processor 160 may control an inverter motor (not shown) driving the fan 81 to increase the rotation speed of the fan 81.

For example, in the first sterilization process or the second sterilization process, the fan 81 may be driven at a rotation speed of 2000 [rpm]. In this case, when the processor 160 starts the cooling process, the rotation speed of the fan 81 may be increased to 2700 [rpm]. This is to lower the temperature in the drum 110 quickly by increasing the air volume by the fan 81.

Thereafter, the processor 160 may end the cooling process when the data sensed by the second sensor 130 reaches a threshold value. Thus, the entire sterilization course may end.

That is, since the temperature of the drum 110 gradually decrease in accordance with driving of the fan 81, a temperature value indicated by the data sensed by the second sensor 130 gradually decreases.

Accordingly, when the data sensed by the second sensor 130 reaches the threshold value, the processor 160 may stop driving of the fan 81 and the drum 110 that are being driven and end the cooling process.

In this case, when the temperature value indicated by the data sensed by the second sensor 130 is 54° C., the processor 160 may end the cooling process.

According to this method, a whole sterilization course may be performed.

Meanwhile, the processor 160 may display operation information about the sterilization course on the display 15-2 when performing the sterilization course.

For example, when the first sterilization process is performed according to a dry state of the object to be dried, the processor 160 may display information about a time spent in the first sterilization process on the display 15-2.

Also, in the first sterilization process, the processor 160 may perform a course for sterilizing the object to be dried when the data sensed through the second sensor 130 reaches the first threshold value. At this time, the processor 160 may display information indicating that the sterilization course is performed and information about a time (for example, the time spent in the sterilization course in the first sterilization processor+the time spent in the cooling process) spent in the sterilization course on the display 15-2.

As another example, when the drying process and the second sterilization process are performed according to the dry state of the object to be dried, the processor 160 may display information about a time spent in the drying process and the second sterilization process on the display 15-2.

Also, in the second sterilization process, the processor 160 may perform a course for sterilizing the object to be dried when the data sensed through the second sensor 130 reaches the second threshold value. At this time, the processor 160 may display information indicating that the sterilization course is performed and information about a time (for example, the time spent in the sterilization course in the second sterilization processor+the time spent in the cooling process) spent in the sterilization course on the display 15-2.

Meanwhile, it is described in the above-described embodiments that the clothes dryer 100 controls the rotation speed of a fan and temperature of the air discharged from the drum 110 for each course.

That is, the clothes dryer 100 may perform the first course to control the heating unit 140 and the blower 150 such that the air discharged from the drum 110 is maintained at the first temperature or higher while maintaining the rotating speed of the fan at the first speed, the second course to control the heating unit 140 and the blower 150 such that the air discharged from the drum 110 is maintained at the second temperature or higher while maintaining the rotation speed of the fan at the second speed, and the third course to control the heating unit 140 and the blower 150 such that the air discharged from the drum 110 is maintained at the third temperature or higher while maintaining the rotation speed of the fan at the third speed. At this time, the first speed may be greater than the second speed and the third speed, and the third temperature may be higher than the first temperature and the second temperature.

However, this is only an example, and the clothes dryer 100 may control the rotation speed of a drum, not the rotation speed of the fan, in each course. In this case, the processor 160 may control the rotation speed of the drum and the temperature of the air discharged from the drum.

More specifically, the clothes dryer 100 may perform the first course to control the drum 110 and the heating unit 140 such that the air discharged from the drum 110 is maintained at the first temperature or higher while maintaining the rotating speed of the drum 110 at the first speed, the second course to control the drum 110 and the heating unit 140 such that the air discharged from the drum 110 is maintained at the second temperature or higher while maintaining the rotation speed of the drum 110 at the second speed, and the third course to control the drum 110 and the heating unit 140 such that the air discharged from the drum 110 is maintained at the third temperature or higher while maintaining the rotation speed of the drum 110 at the third speed. At this time, the first speed may be greater than the second speed and the third speed, and the third temperature may be higher than the first temperature and the second temperature.

In this case, the processor 160 may control the clothes dryer 100 to perform the second course after performing the first course or perform the third course without performing the first course, based on the dry state of the object to be dried sensed by the first sensor 120.

That is, the processor 160 may differentiate the rotation speed of the drum 110 in the drying process, the first sterilization process, and the second sterilization process. In this case, the rotation speed of the fan may be constant, and operations of the other components are the same as those of the above-described embodiments, and thus detailed descriptions thereof will be omitted.

Figure 12:
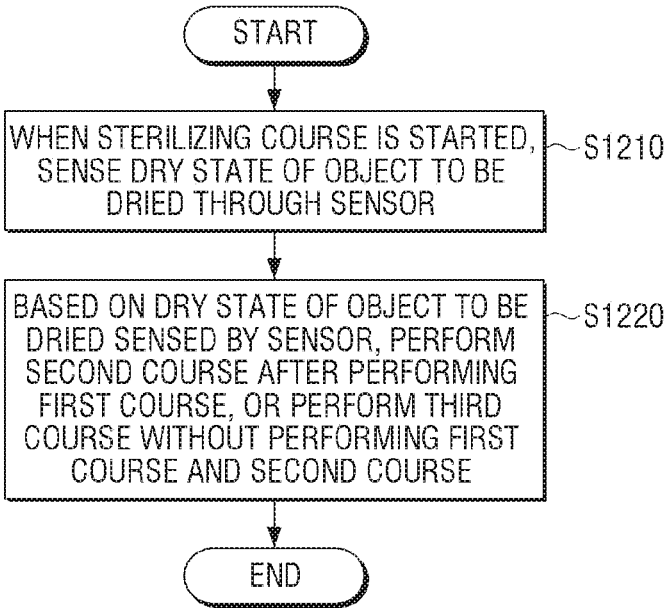
FIG. 12 is a flowchart illustrating a method for performing a sterilization course of a clothes dryer according to an embodiment of the disclosure.

FIG. 12 is a flowchart illustrating a method for performing a sterilization course of a clothes dryer according to an embodiment of the disclosure.

First, when the sterilizing course is started, a dry state of an object to be dried is sensed through a first sensor for sensing the dry state of the object to be dried contained in a drum (S1210).

Then, based on the dry state of the object to be dried sensed by the first sensor, a second course is performed after performing a first course, or a third course is performed without performing the first course and the second course (S1220).

Here, the first course is performed such that air discharged from the drum is a first temperature or higher while a rotation speed of a fan is maintained at a first speed, and the second course is performed such that the air discharged from the drum is a second temperature or higher while the rotation speed of the fan is maintained at a second speed, and the third course is performed such that the air discharged from the drum is a third temperature or higher while the rotation speed of the fan is maintained at a third speed. The first speed is greater than the second speed and the third temperature, and the third temperature is higher than the first temperature and the second temperature.

Here, in step S1220, when data sensed by the first sensor is less than or equal to a predetermined value, the third course may be started to drive a compressor included in the clothes dryer according to a predetermined operation frequency and drive the fan at a predetermined rotation speed, and when data sensed by a second sensor sensing temperature of the air discharged from the drum reaches a first threshold value, temperature of the drum may be maintained at the third temperature or higher for a predetermined time.

In step S1220, when the data sensed by the first sensor is greater than the predetermined value, after the first course is performed, and when the data sensed by the first sensor is less than or equal to the predetermined value, the second course may be started to drive the fan at the predetermined rotation speed.

In step S1220, the compressor may be driven according to the predetermined operation frequency in the first course, the fan may be driven at the predetermined rotation speed, when the first course ends, the second course may be started and the rotation speed of the fan may be reduced.

In step S1220, when the data sensed by the second sensor reaches the second threshold value after the second course is started, the temperature of the drum may be maintained at the second temperature or higher for a predetermined time.

Also, in step S1220, when the data sensed by the first sensor is less than or equal to the predetermined value, the third course may be started to drive a heater included in the clothes dryer, turn off the compressor included in the clothes dryer, drive the fan at a predetermined rotation speed, and when the data sensed by the second sensor sensing the temperature of the air discharged from the drum reaches the first threshold value, the temperature of the drum may be maintained at the third temperature or higher for a predetermined time through on/off of the heater.

In step S1220, when the data sensed by the first sensor is greater than the predetermined value, after the first course is performed, the second course may be started when the data sensed by the first sensor is less than or equal to the predetermined value.

In step S1220, the compressor may be driven according to the predetermined operation frequency in the first course, the fan may be driven at the predetermined rotation speed, when the first course ends, the second course may be started to drive the heater, turn off the compressor, and drive the fan at the predetermined rotation speed.

In step S1220, when the data sensed by the second sensor reaches the second threshold value after the second course is started, the temperature of the drum may be maintained at the second temperature or higher for a predetermined time through on/off of the heater.

Meanwhile, when the second course or the third course ends, a cooling process may be performed.

In this case, the rotation speed of the fan in the cooling process may be higher than the rotation speed of the fan in the second and third courses.

Meanwhile, in the above-described example, the first course may be performed such that the air discharged from the drum is maintained at the first temperature or higher while maintaining the rotation speed of the drum at the first speed, the second course may be performed such that the air discharged from the drum is maintained at the second temperature or higher while maintaining the rotation speed of the drum at the second speed, and the third course may be performed such that the air discharged from the drum is maintained at the third temperature or higher while maintaining the rotation speed of the drum at the third speed. Here, the first speed may be greater than the second speed and the third speed, and the third temperature may be higher than the first temperature and the second temperature.

The method of performing the sterilization course of the clothes dryer has been described above.

A non-transitory computer readable medium may be provided in which a program for sequentially method of performing the sterilization course according to the disclosure is stored.

The non-transitory readable medium is not a medium for storing data for a short time such as a register, a cache, a memory, etc., but means a medium that semi-permanently stores data and may be read by a device. In particular, the various applications or programs described above may be stored on non-volatile readable media such as CD, DVD, hard disk, bluray disk, USB, memory card, ROM, etc.

In the above-described block diagram of the clothes dryer, although a bus is not shown, communication between components in the clothes dryer may be performed through the bus. Further, the clothes dryer may further include a processor such as a CPU, a microprocessor, or the like that performs the various steps described above.

Although the embodiments of the disclosure have been illustrated and described hereinabove, the disclosure is not limited to the abovementioned specific embodiments, but may be variously modified by those skilled in the art to which the disclosure pertains without departing from the scope and spirit of the disclosure as disclosed in the accompanying claims. These modifications should also be understood to fall within the scope of the disclosure.

Although the disclosure has been described with various embodiments, various changes and modifications may be suggested to one skilled in the art. It is intended that the disclosure encompass such changes and modifications as fall within the scope of the appended claims.

What is claimed is:

1. A clothes dryer comprising:

a drum configured to accommodate an object to be dried;

a first sensor configured to sense a dry state of the object to be dried accommodated in the drum;

a heating unit configured to heat air supplied into the drum;

a blower comprising a fan configured to generate a flow of the air passing through an inside of the drum;

a second sensor configured to sense a temperature of air discharged from the drum; and a processor configured to:

control a rotation speed of the drum, control a temperature of the air discharged from the drum, and control a rotation speed of the fan, wherein the clothes dryer performs:

a first course comprising control of the heating unit and the blower, wherein the air discharged from the drum has at least a first temperature while the rotation speed of the fan is maintained at a first speed;

a second course comprising control of the heating unit and the blower, wherein the air discharged from the drum has at least a second temperature while the rotation speed of the fan is maintained at a second speed; and a third course comprising control of the heating unit and the blower, wherein the air discharged from the drum has at least a third temperature while the rotation speed of the fan is maintained at a third speed, wherein the processor is configured to control the clothes dryer to either (i) perform the second course after performing the first course or (ii) perform the third course without performing the first course and the second course based on the dry state of the object to be dried sensed by the first sensor, wherein the first speed is greater than the second speed and the third speed, and wherein the third temperature is higher than the first temperature and the second temperature.

2. The clothes dryer of claim 1, further comprising a flow path that is a circulation path of the air discharged from the drum and flowing into the drum, wherein the heating unit comprises a compressor connected to the flow path and configured to cool and heat the air circulating through the flow path.

3. The clothes dryer of claim 2, wherein:

when data sensed by the first sensor is less than or equal to a predetermined value, the processor is configured to start the third course to drive the compressor at a predetermined operation frequency and drive the fan at a predetermined rotation speed, and when the data sensed by the second sensor reaches a first threshold value, the processor is configured to maintain a temperature of the drum at the third temperature or higher for a predetermined time.

4. The clothes dryer of claim 3, wherein:

when the data sensed by the first sensor is greater than the predetermined value, the processor is configured to perform the first course, when the data sensed by the first sensor is less than or equal to the predetermined value, the processor is configured to start the second course to drive the fan at the predetermined rotation speed, and the processor is further configured to drive the compressor according to the predetermined operation frequency in the first course, drive the fan at the predetermined rotation speed, start the second course when a drying process ends, and reduce the rotation speed of the fan.

5. The clothes dryer of claim 3, wherein, when the data sensed by the first sensor is greater than the predetermined value, the processor is configured to perform the first course, when the data sensed by the first sensor is less than or equal to the predetermined value, the processor is configured to start the second course to drive the fan at the predetermined rotation speed, and when the data sensed by the second sensor reaches a second threshold value after the second course is started, the processor is further configured to maintain the temperature of the drum at the second temperature or higher for a predetermined time.

6. The clothes dryer of claim 1, further comprising a flow path that is a circulation path of the air discharged from the drum and flowing into the drum, wherein the heating unit comprises:

a compressor connected to the flow path and configured to cool and heat the air circulating through the flow path; and a heater configured to heat the air flowing into the drum through the flow path.

7. The clothes dryer of claim 6, wherein:

when data sensed by the first sensor is less than or equal to a predetermined value, the processor is configured to start the third course to drive the heater, turn off the compressor, and drive the fan at a predetermined rotation speed, and when the data sensed by the second sensor reaches a first threshold value, the processor is configured to perform a course for sterilization of the object to be dried and to maintain a temperature of the drum at the third temperature or higher for a predetermined time through control of the heater.

8. The clothes dryer of claim 7, wherein:

when the data sensed by the first sensor is greater than the predetermined value, the processor is configured to perform the first course on the object to be dried, and when the data sensed by the first sensor is less than or equal to the predetermined value, the processor is configured to start the second course, the processor is configured to:

drive the compressor according to a predetermined operation frequency in the first course, drive the fan at the predetermined rotation speed, and when the first course ends, start the second course, wherein starting the second course comprises driving the heater, turning off the compressor, and driving the fan at the predetermined rotation speed, and when the data sensed by the second sensor reaches a second threshold value after starting the second course, the processor is further configured to maintain the temperature of the drum at the second temperature or higher for a predetermined time through control of the heater.

9. The clothes dryer of claim 1, wherein:

the processor is configured to perform a cooling process when at least one of the second course or the third course ends.

10. The clothes dryer of claim 9, wherein a rotation speed of the fan in the cooling process is higher than a rotation speed of the fan in the second course and the third course.

11. A clothes dryer comprising:

a drum configured to accommodate an object to be dried;

a first sensor configured to sense a dry state of the object to be dried accommodated in the drum;

a heating unit configured to heat air supplied into the drum;

a blower configured to generate a flow of the air passing through an inside of the drum;

a second sensor configured to sense a temperature of air discharged from the drum; and a processor configured to:

control a rotation speed of the drum, and control a temperature of the air discharged from the drum, wherein the clothes dryer performs:

a first course comprising control of the drum and the heating unit, wherein the air discharged from the drum has at least a first temperature while the rotation speed of the drum is maintained at a first speed;

a second course comprising control of the drum and the heating unit, wherein the air discharged from the drum has at least a second temperature while the rotation speed of the drum is maintained at a second speed; and a third course comprising control of the drum and the heating unit, wherein the air discharged from the drum has at least a third temperature while the rotation speed of the drum is maintained at a third speed, wherein the processor is configured to control the clothes dryer to either (i) perform the second course after performing the first course or (ii) perform the third course without performing the first course, based on the dry state of the object to be dried sensed by the first sensor, wherein the first speed is greater than the second speed and the third speed, and wherein the third temperature is higher than the first temperature and the second temperature.

12. A method for performing a sterilization course, the method comprising:

sensing a dry state of an object to be dried in a clothes dryer through a first sensor for sensing the dry state of the object to be dried contained in a drum when the sterilization course is started; and performing a second course after either (i) performing a first course or (ii) performing a third course without performing the first course and the second course based on the dry state of the object to be dried sensed by the first sensor, wherein the first course is performed to allow air discharged from the drum to have at least a first temperature while a rotation speed of a fan is maintained at a first speed, wherein the second course is performed to allow the air discharged from the drum to have at least a second temperature while the rotation speed of the fan is maintained at a second speed, wherein the third course is performed to allow the air discharged from the drum to have at least a third temperature while the rotation speed of the fan is maintained at a third speed, wherein the first speed is greater than the second speed and the third speed, and wherein the third temperature is higher than the first temperature and the second temperature.

13. The method of claim 12, wherein performing the sterilization course further comprises:

when data sensed by the first sensor is less than or equal to a predetermined value, starting the third course to drive a compressor included in the clothes dryer at a predetermined operation frequency and drive the fan at a predetermined rotation speed, and when data sensed by a second sensor configured to sense a temperature of air discharged from the drum reaches a first threshold value, maintaining a temperature of the drum at the third temperature or higher for a predetermined time.

14. The method of claim 13, wherein performing the sterilization course further comprises:

when the data sensed by the first sensor is greater than the predetermined value, performing the first course, when the data sensed by the first sensor is less than or equal to the predetermined value, starting the second course to drive the fan at the predetermined rotation speed, driving the compressor according to the predetermined operation frequency in the first course, driving the fan at the predetermined rotation speed, starting the second course when the first course ends, and reducing the rotation speed of the fan.

15. The method of claim 13, wherein performing the sterilization course further comprises:

when the data sensed by the first sensor is greater than the predetermined value, performing the first course, when the data sensed by the first sensor is less than or equal to the predetermined value, starting the second course to drive the fan at the predetermined rotation speed, and when the data sensed by the second sensor reaches a second threshold value after starting the second course, maintaining the temperature of the drum at the second temperature or higher for a predetermined time.

16. The method of claim 12, wherein performing the sterilization course further comprises:

when data sensed by the first sensor is less than or equal to a predetermined value, starting the third course to drive a heater included in the clothes dryer, turning off a compressor included in the clothes dryer, and driving the fan at a predetermined rotation speed, and when data sensed by a second sensor configured to sense a temperature of air discharged from the drum reaches a first threshold value, maintaining a temperature of the drum at the third temperature or higher for a predetermined time through control of the heater.

17. The method of claim 16 wherein performing the sterilization course further comprises:

when the data sensed by the first sensor is greater than the predetermined value, performing the first course, and when the data sensed by the first sensor is less than or equal to the predetermined value, starting the second course.

18. The method of claim 17, wherein performing the sterilization course further comprises:

driving the compressor according to a predetermined operation frequency in the first course, driving the fan at the predetermined rotation speed, and when the first course ends, starting the second course, the second course comprising driving the heater, turning off the compressor, and driving the fan at the predetermined rotation speed.

19. The method of claim 18, wherein performing the sterilization course further comprises, when the data sensed by the second sensor reaches a second threshold value after starting the second course, maintaining the temperature of the drum at the second temperature or higher for a predetermined time through control of the heater.

20. The method of claim 12, further comprising performing a cooling process when at least one of the second course or the third course ends, wherein a rotation speed of the fan in the cooling process is higher than a rotation speed of the fan in the second course and the third course.

* * * * *